US005570596A

United States Patent [19]

Imai et al.

[11] Patent Number: 5,570,596

[45] Date of Patent: Nov. 5, 1996

[54] AUTOMATIC WASHING MACHINE WITH IMPROVED ARRANGEMENT FOR PREVENTING INSUFFICIENCY IN SUPPLIED WATER IN RINSE STEP

[75] Inventors: Masahiro Imai, Tajimi; Yoshiyuki Makino; Satoru Matsumoto, both of Seto; Kimihiko Nakamura, Tajimi; Kiyoshi Okazaki; Takayuki Hirano, both of Seto, all of Japan

[73] Assignee: Kabushiki Kaisha Toshiba, Kanagawa-ken, Japan

[21] Appl. No.: 489,724

[22] Filed: Jun. 13, 1995

[30] Foreign Application Priority Data

Jun. 29, 1994 [JP] Japan ..... 6-147713
Jul. 18, 1994 [JP] Japan ..... 6-165134

[51] Int. Cl.[6] ..... D06F 33/02

[52] U.S. Cl. ..... 68/12.05; 68/12.02; 68/12.12; 68/12.19; 68/12.27; 68/23.5

[58] Field of Search ..... 68/12.02, 12.05, 68/12.12, 12.19, 12.27, 23.5

[56] References Cited

U.S. PATENT DOCUMENTS 4,480,449 11/1984 Getz et al. ..... 68/12.02
4,838,050 6/1989 Azuma ..... 68/12
5,305,485 4/1994 Getz et al. ..... 68/12.19 X

FOREIGN PATENT DOCUMENTS 57-200193 12/1982 Japan ..... D06F 39/08
61-213092 9/1986 Japan ..... D06F 33/02
63-230197 9/1988 Japan ..... D06F 41/00

*Primary Examiner*—Philip R. Coe
*Attorney, Agent, or Firm*—Limbach & Limbach

[57] ABSTRACT

A washing machine includes a dehydrating tub whose interior is divided by rotational angle detecting elements into a plurality of circumferential areas. A period of time required for each area to pass a water pouring location is cumulated by a timer function of a microcomputer in a rinse-with-dehydration operation in which the dehydrating tub is rotated with water being supplied to the tub, A quantity of water poured into or contained in laundry in each area is determined on the basis of a cumulated value so that insufficiency in the quantity of poured water due to rotational unevenness of the dehydrating tub is solved. The washing machine further includes an area display which has area display sections corresponding to the areas and which displays the hydrous state of the laundry in each area, The area display also serves to display the rotational state of the dehydrating tub and an agitator,

17 Claims, 19 Drawing Sheets

FIG. 4A OUTPUT OF HALL IC

FIG. 4B SET AREAS OF ROTATABLE TUB

| MOTOR | LOW SPEED | HIGH SPEED |
|---|---|---|
| WATER-SUPPLY VALVE | OPEN | CLOSED |

TIME →

AUTOMATIC WASHING MACHINE WITH IMPROVED ARRANGEMENT FOR PREVENTING INSUFFICIENCY IN SUPPLIED WATER IN RINSE STEP

BACKGROUND OF THE INVENTION

1. Field of the Invention

This invention relates to washing machine comprising a dehydrating tub which is rotated at high speeds in a dehydration step so that laundry accommodated therein is centrifugally dehydrated, and more particularly to such washing machines performing a rinse-with-dehydration operation in which the dehydrating tub is rotated in a rinse step with water being supplied to the tub so that the laundry is rinsed.

2. Description of the Prior Art

A rinse-with-dehydration operation is executed in some types of conventional washing machines. In the rinse-with-dehydration operation, water is supplied to a dehydrating tub which is being rotated at low speeds in a rinse step (execution of a water pouring stage) and thereafter, the dehydrating tub is rotated at high speeds with stop of water supply so that laundry is centrifugally dehydrated (execution of a dehydrating stage). The dehydrating tub is usually driven by a capacitor motor in these washing machines. The dehydrating tub and accordingly, the capacitor motor are rotated at low speeds in the water pouring stage of the rinse-with-dehydration operation. For this purpose, the motor is controlled to be turned on and off alternately repeatedly so as to be maintained at low speeds.

In the control manner as described above, however, the rotational speed of the dehydrating tub is lower when the motor is off than when the motor is on, that is, the rotational speed of the dehydrating tub is repeatedly increased and decreased alternately. Consequently, water is not supplied uniformly to the laundry in the dehydrating tub, and part of the laundry sometimes contains insufficient water, which results in insufficient rinsing in the part of the laundry.

SUMMARY OF THE INVENTION

Therefore, an object of the present invention is to provide a washing machine wherein water content distribution in the laundry can be determined during the rinse-with-dehydration operation so that occurrence of the insufficient rinsing in part of the laundry can be prevented.

The present invention provides a washing machine comprising an electric motor, a dehydrating tub provided to be rotated by the electric motor and centrifugally dehydrating laundry accommodated therein when rotated at high speeds, and water-supply means for supplying water to the dehydrating tub so that the water is poured onto the laundry. Speed selecting means selects a rotational speed of the dehydrating tub between a low speed state establishing a water pouring stage and a high speed state establishing a centrifugal dehydration stage, thereby performing a rinse-with-dehydration operation in which the water is supplied to the dehydrating tub by the water-supply means in the water pouring stage so that the laundry is rendered hydrous and in which the water supply by the water-supply means is substantially stopped and the laundry is centrifugally dehydrated in the centrifugal dehydration stage subsequent to the water pouring stage. Means is provided for detecting a rotation angle of the dehydrating tub in the water pouring stage. Area setting means is provided for setting the interior of the dehydrating tub into a plurality of circumferential areas according to the detected rotation angle. Timer means is provided for detecting a period of time required for each set area to pass a water pouring location of the water-supply means. Means is provided for determining a hydrous state of the laundry on the basis of the result of detection by the timer means.

In the washing machine constituted as described above, the timer means detects the time period required for each set area to pass the water pouring location of the water-supply means. A quantity of water received by the laundry located at each area set by the area setting means is rendered small as the time period required for the corresponding set area to pass the water pouring location is rendered shorter. In contrast with this, the quantity of water received by the laundry located at each set area is rendered large as the time period required for the corresponding set area to pass the water pouring location is rendered longer. Accordingly, a hydrous or water content state of the laundry is determined on the basis of the result of detection by the timer means, whereby a quantity of water received by the laundry located at each set area is obtained. Consequently, occurrence of insufficiency in the rinsing in part of the laundry can be prevented.

The washing machine may further comprise water-supply control means stopping the water supply when the time periods required for all the set areas to pass the water pouring location each become equal to or exceed a predetermined reference period of time, the time periods being detected by the timer means. Alternatively, water-supply control means may be provided for controlling the water-supply means so that the same sequentially stops the water supply to the set areas when the time periods required for the respective set areas to pass the water supply location sequentially become equal to or exceed a reference period of time, the time periods being detected by the timer means.

The washing machine may further comprise water-supply capacity determining means for determining the water-supply capacity of the water-supply means and reference time period changing means for changing the reference time period according to the result of detection by the water-supply capacity determining means. This arrangement can prevent insufficiency in the quantity of water contained in the laundry due to variations in water supply flow rate.

The washing machine may further comprise a display having display sections displaying the respective set areas and display control means for activating the display sections corresponding to the set areas when the time periods required for the respective set areas to pass the water supply location each become equal to or exceed a reference period of time so that a display status is switched, the time periods being detected by the timer means.

The washing machine may further comprise an agitator provided in the dehydrating tub, rotation detecting means for detecting rotation of the motor, thereby generating a detection signal, monitor control means, responsive to the detection signal from the rotation detection means, for controlling the display so that the display sections sequentially emit light during rotation of either the agitator or the dehydrating tub. In this arrangement, the display sections of the display are arranged into the form of a loop.

According to the above-described arrangement, when the agitator or the dehydrating tub is rotated in the stages other than the water pouring stage in the rinse-with-dehydration operation, the display sections constituting the display are sequentially lighted so that light emission is looped. This manner of light indicates that the agitator or the dehydrating tub is being rotated. Thus, the display for displaying the set areas is also used for displaying the rotational state of the dehydrating tub and the agitator disposed in the tub for the wash operation.

The light emitting portion emitting the light on the display may be shifted sequentially from one light transmitting portion to another at a speed according to a rotational speed of the dehydrating tub or the agitator and in a direction same as a direction of rotation of the dehydrating tub or the agitator.

The light-emitting elements may be capable of emitting a plurality of different colors and the color of light emitted by the light-emitting elements may be differentiated one step of the washing operation from another.

All the light-emitting elements may be turned on, turned off, or flashed during stop of the dehydrating tub or the agitator.

The display may also serve to display a selected water-level and light may be emitted from one of the display sections corresponding to the selected water-level when the water level is displayed. Furthermore, the display may also serve to display a remaining period of time of a wash step and light may be emitted from one of the display sections corresponding to a remaining time period of the wash step under a given operation mode.

BRIEF DESCRIPTION OF THE DRAWINGS

Other objects, features and advantages of the present invention will become clear upon reviewing the following description of preferred embodiments thereof, made with reference to the accompanying drawings, in which.

DESCRIPTION OF THE PREFERRED EMBODIMENTS

Figure 1:
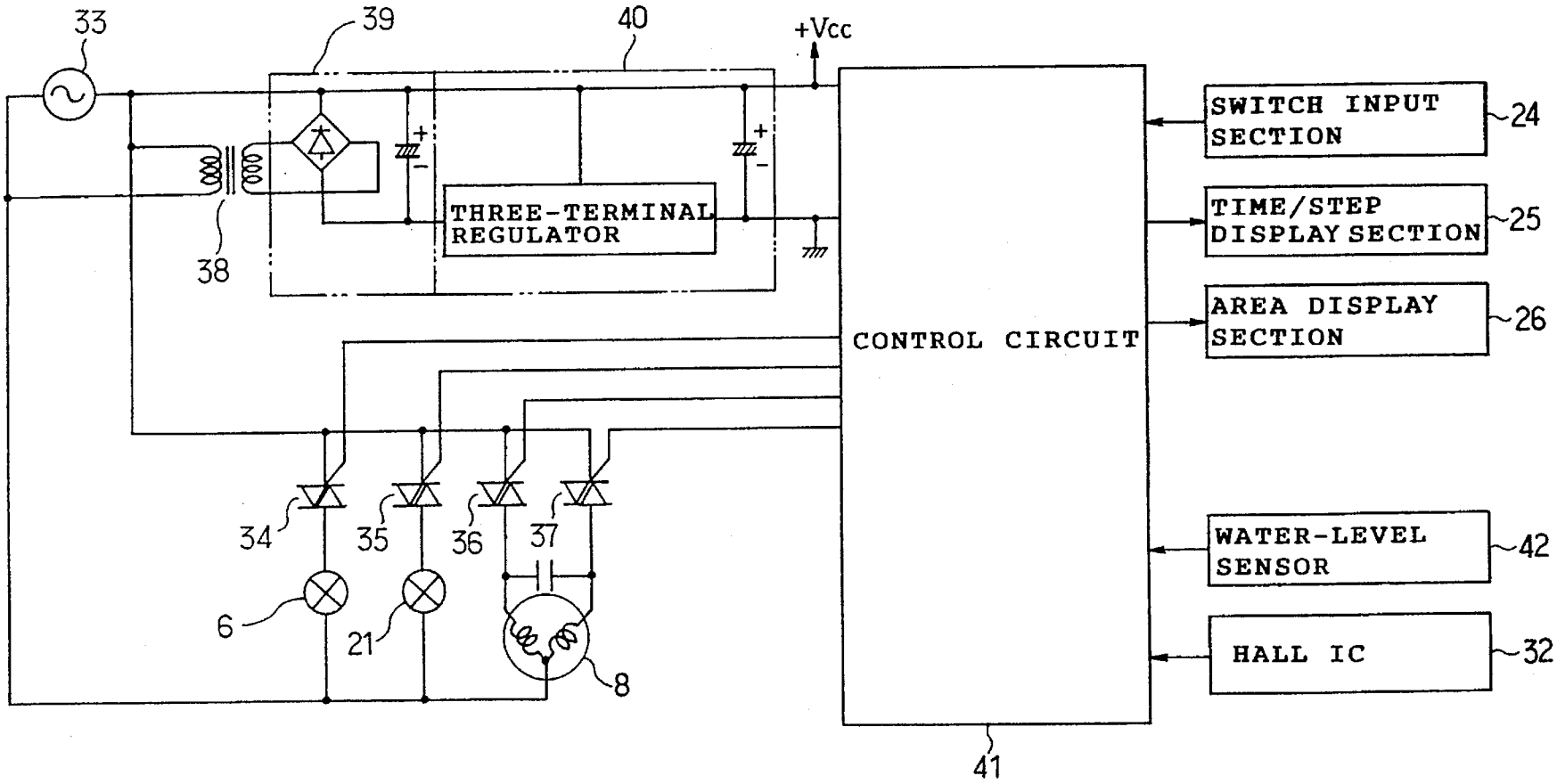
FIG. 1 is an electrical circuit diagram showing an electrical arrangement of a washing machine of a first embodiment according to the present invention.

A first embodiment of the present invention will be described with reference to FIGS. 1 to 8. Referring to FIG. 2, an automatic washing machine according to the present invention is shown. An outer cabinet 1 encloses an outer tub 2 mounted on a suspension mechanism 3 part of which is shown. A rotatable tub 4 serving as a wash tub and a dehydrating tub is provided in the outer tub 2. An agitator 5 is rotatably mounted on the bottom of the rotatable tub 4. The outer tub 2 has a drain hole formed in the bottom thereof. The drain hole communicates via a drain valve 6 with a drain hose 7, the latter two being located beneath the drain hole, so as to drain water from the tubs 2 and 4. A drive mechanism 9 is also provided beneath the outer tub 2 and includes an electric motor 8 such as a capacitor induction motor. The agitator 5 is rotated by the drive mechanism 9 without rotation of the tub 4 in a wash step and a stored-water rinse operation in which laundry is rinsed with water being stored in the tub 4. The drive mechanism 9 further includes a belt transmission mechanism 9*a* and a reduction gear mechanism 9*b*. The belt transmission mechanism 9*a* is in the reduction ratio of 1:1.5 while the reduction gear mechanism 9*b* is in the reduction ratio of 1:5 in the wash step and of 1:1 in a dehydration step and a rinse-with-dehydration operation.

The rotatable tub 4 has a number of dehydrating holes 11 formed only in its upper portion to which a balancing ring 10 is mounted. Water is discharged through the dehydrating holes 11 and a gap between the balancing ring 10 and the upper portion of the rotatable tub 4 in the dehydration step. A flat ring tub cover 12 is mounted to the upper portion of the tub 2. An inner lid 13 has rear shafts 14 pivotally mounted on the tub cover 12, so that an opening of the tub cover 12 is opened and closed. Accordingly, the inner lid 13 is located over the rotatable tub 4 and covers the same in the closed state.

A concavity 15 is formed in the rear central portion of the inner lid 13. The concavity 15 has an inclined bottom gradually lowered from the front to the rear. Number of water-passing holes 16 are formed in the lowermost rear of the concavity 15, so that the concavity 15 serves as a water-passing section. An auxiliary cover 17 is attached to the upper open end of the concavity 15 so as to cover the upper open end of the concavity 15 except for the portion located over the water-passing holes 16. A handle 18 for opening the lid is provided on the front of the inner lid 13. A top cover 19 is mounted over the inner lid 13 and the tub cover 12. The top cover 19 is provided with an outer lid 20 and a water supply unit 22 serving as water-supply means and comprising a water-supply valve 21 which is located in the rear of the concavity 15 of the inner lid 13 to supply water to the concavity 15.

Figure 3:
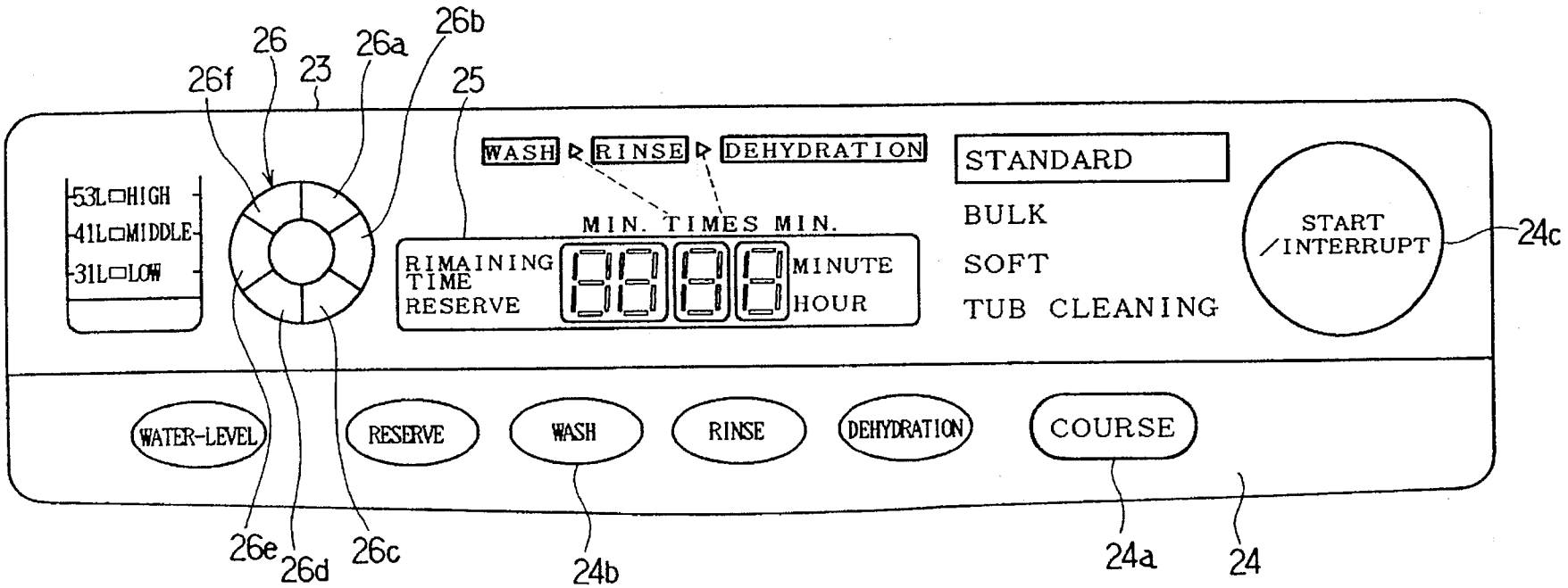
FIG. 3 is a front view of an operation panel of the washing machine.
Figure 4:
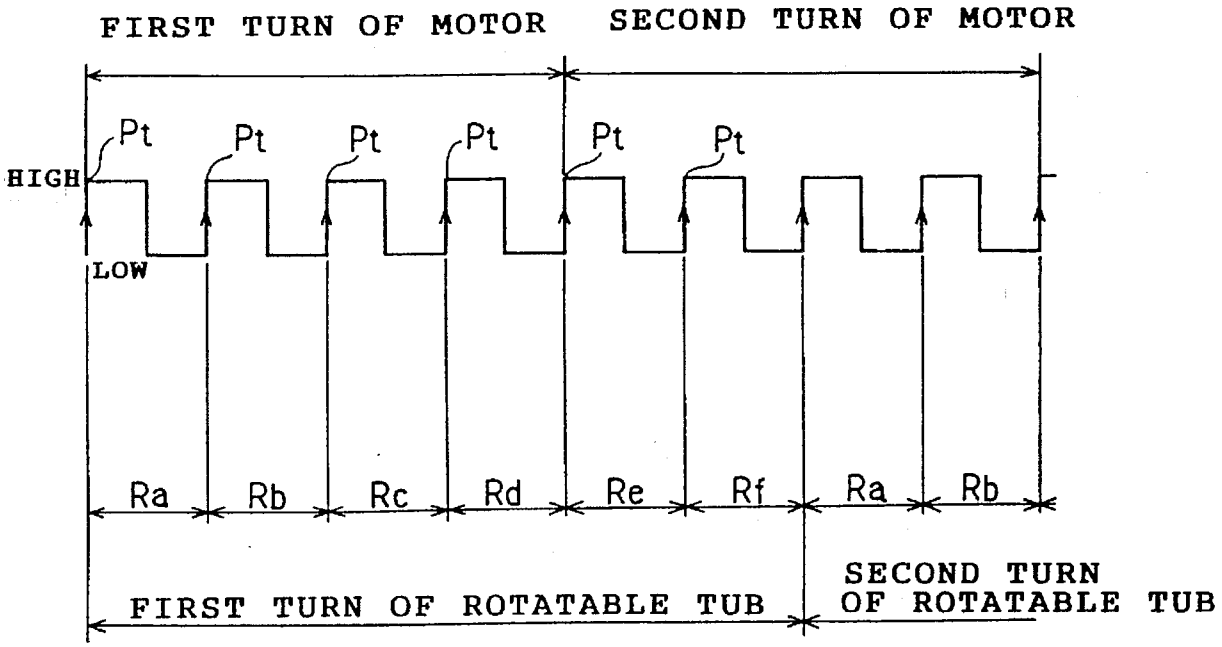
FIGS. 4A and 4B show the relation between the status of an output signal of a Hall IC and set areas of a rotational tub.

An operation panel 23 as shown in FIG. 3 is provided on the front of the top cover 19. The operation panel 19 is provided with a switch input section 24 which includes a course selecting switch 24*a*, a wash time period setting switch 24*b*, a start switch 24*c* and etc., a time and step display 25, and an area display 26. The area display 26 is formed into the shape of a circular doughnut and has display sections 26*a* to 26*f* formed by equally dividing the display 26 into six segments each of which comprises a light-emitting diode (LED).

A water-passing hole 27 is formed in the bottom of the rotatable tub 4 and communicates with the drain valve 6 via a flow path 28 formed in the bottom of the tub 2. Water reaches the flow path 28 when reserved in the rotatable tub 4. However, the water is not reserved in the tub 2. In a draining operation, the water is drained from the tub 4 through the water-passing hole 27, the flow path 28, the drain valve 6 and the drain hose 7. In a dehydration step, water flowing through the dehydrating holes 11 of the tub 4 into the outer tub 2 is drained through another drain hole 29, a connecting pipe (not shown) connected to the drain hose 7.

The motor 8 includes rotation detecting means or a rotation detecting device 30 provided at the side opposite to an output side of a main shaft thereof. The rotation detecting device 30 comprises an eight-pole permanent magnet 31 and a Hall IC 32 mounted on a cover 31*a* for the permanent magnet 31.

Figure 2:
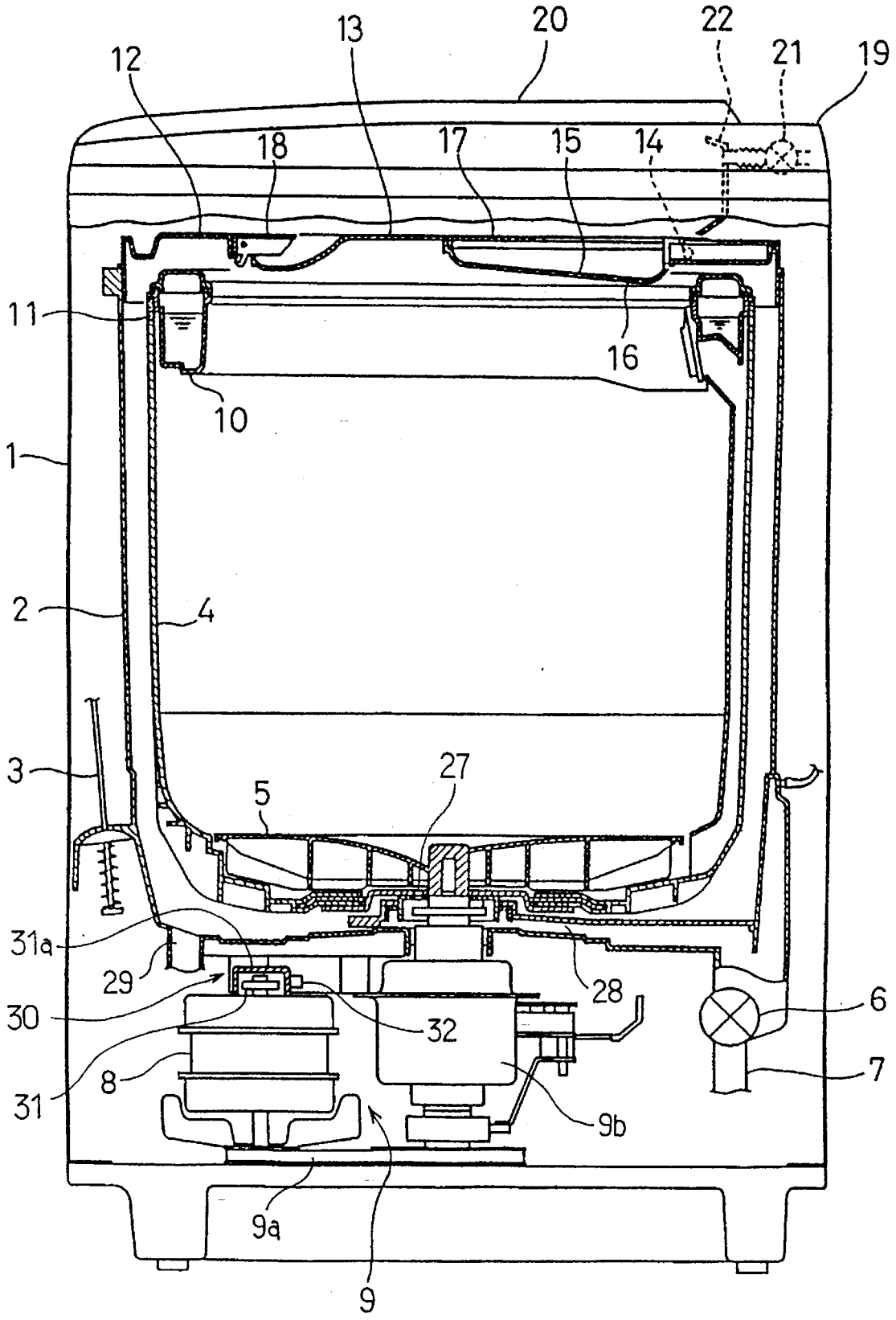
FIG. 2 is a longitudinally sectional side view of the washing machine.

Referring to FIG. 1, an electrical arrangement of the washing machine is shown. The drain valve 6, the water-supply valve 21 and the motor 8 are connected via triacs 34 to 37 to a commercial AC power supply 33. The triac 36 is for the forward rotation of the motor 8 while the triac 37 is for the reverse rotation of the motor 8. A rectifier circuit 39 is also connected via a step-down transformer 38 to the AC power supply 33. A voltage regulator circuit 40 including a switching regulator 40*a* is connected to an output side of the rectifier circuit 39, so that a DC regulated voltage is supplied to a control circuit 41.

The control circuit 41 comprises a microcomputer and analog-to-digital (A/D) converters. The control circuit 41 is supplied with input signals from the switch input section 24, a water-level sensor 42 and the Hall IC 32. In response to these input signals, the control circuit 41 turns on and off the triacs 34–37 according to a program stored therein, thereby controlling the drain valve 6, the water-supply valve 21, the motor 8, the time and step display 25 and the area display 26. The above-described water-level sensor 42 is provided in the rear interior of the top cover 19 as shown in FIG. 2.

The control circuit 41 executes the wash step, the rinse-with-dehydration operation and the dehydration step sequentially when a STANDARD course is selected, for example. Furthermore, the control circuit 41 serves as water-supply capacity determining means and reference time period changing means at the time of water supply in the wash step. Additionally, the control circuit 41 serves as area setting means, timer means, water-supply control means and display control means at the time of the rinse-with-dehydration operation. Control manners regarding these functions of the control circuit 41 will be described with reference to FIGS. 7 and 8.

Figure 7:
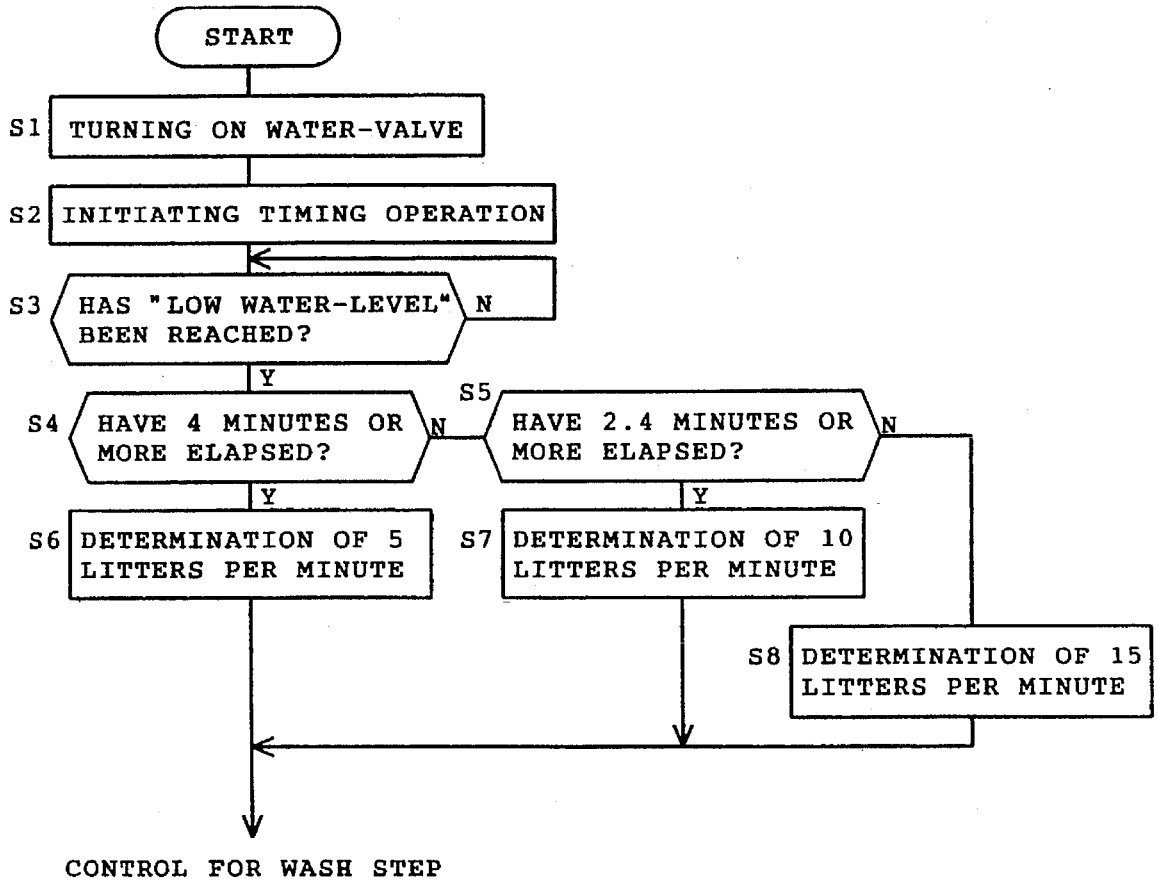
FIG. 7 is a flowchart showing a control manner for determination of the water supply capacity.

FIG. 7 shows the control manner at the time of the water supply in the wash step in the STANDARD course. First, the water-supply valve 21 is turned on at step S1 so that the water supply is initiated. A timing operation is initiated at step S2. The control circuit 41 then determines at step S3 as to whether or not the water in the tub 4 has reached a LOW WATER-LEVEL which is a previously set lowest level. When the water has reached the LOW WATER-LEVEL, the control circuit 41 determines at step S4 as to whether or not a first reference period of time for determination of water-supply capacity, for example, 4 minutes, or more has elapsed, based on the timing operation initiated at step S2. The control circuit 41 further determines at step S5 as to whether or not a second reference period of time for determination of water-supply capacity, for example, 2.4, or more has elapsed, based on the timing operation initiated at step S2.

When the first reference time period or more has elapsed, the water-supply capacity of the water supply unit 22 is determined to be 5 litters per minute at step S6. When a clocked period is less than 4 minutes and 2.4 minutes or more, the water-supply capacity of the water supply unit 22 is determined to be 10 litters per minute at step S7. When the clocked period is less than 2.4 minutes, the water-supply capacity of the water supply unit is determined to be 15 litters per minute at step S8. Subsequently, the water supply is stopped when the LOW WATER-LEVEL has been previously set for the wash step, or the water supply is continued until either one of "HIGH LEVEL" and "MIDDLE LEVEL" which has been set is reached. Thereafter, the control circuit 41 controls the wash step.

Figures 5, 6:
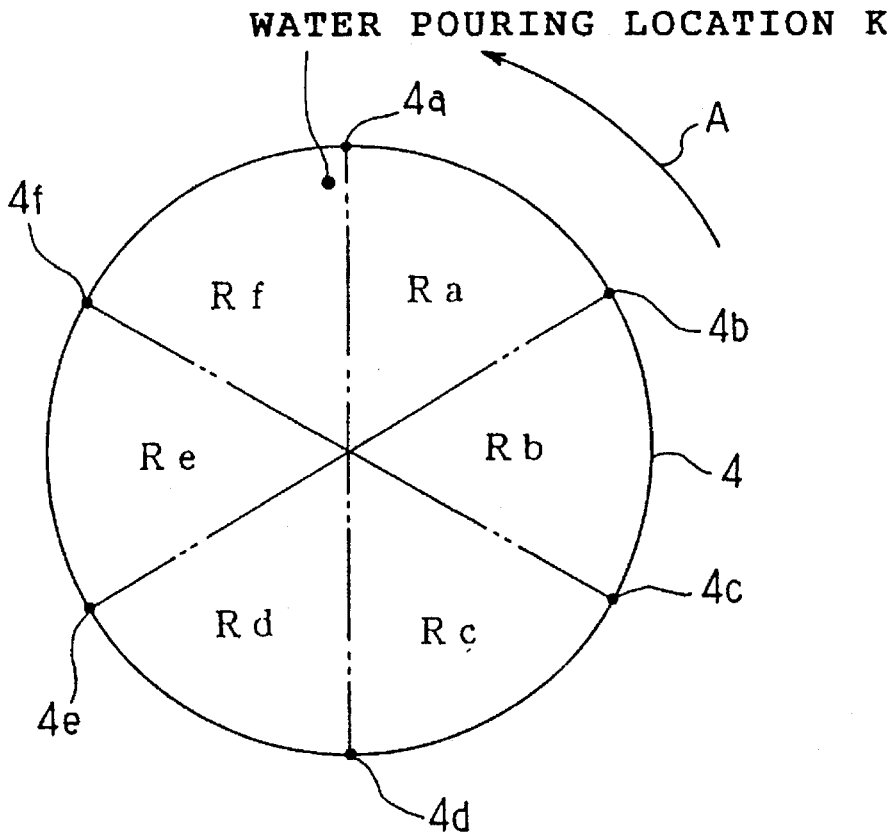
FIG. 5 is a time chart showing a rinse-with-dehydration operation.
FIG. 6 is a diagram showing set areas in a rotational tub.

The operation of the rotation detecting device 30 will now be described. The permanent magnet 31 of the rotation detecting device 30 is magnetized so as to have eight poles. Accordingly, the Hall IC 32 generates four pulses every one turn of the motor 8, as shown in FIG. 4A. Since the rotational ratio of the motor 8 to the rotatable tub 4 is 1:1.5 in the rinse-with-dehydration operation, one turn of the rotatable tub 4 corresponds to six pulses as shown in FIG. 4B. More specifically, one turn of the rotatable tub 4 is detected when pulse rise $P_t$ is counted six times. That is, a rotation angle, 360°/6, of the rotatable tub 4 is detected on the basis of each pulse rise $P_t$. Accordingly, when a water pouring location of the water supply unit 22 with respect to the rotatable tub 4 is K and the tub 4 is rotated in the direction of arrow A, as shown in FIG. 6, pulse rise $P_t$ takes place six times at each of six points 4*a*, 4*b*, 4*c*, 4*d*, 4*e* and 4*f* on the rotatable tub 4. Consequently, the interior of the rotatable tub 4 can be circumferentially divided into a plurality of (six in the embodiment) set areas Ra, Rb, Rc, Rd, Re and Rf.

The rinse-with-dehydration operation in the STANDARD course is a combination of a low speed operation in which the rotatable tub 4 is maintained at a predetermined low speed and a high speed operation in which the tub 4 is maintained at a predetermined high speed, as shown in FIG. 5. In the speed control of the motor 8 in the low speed operation, the motor 8 is turned on and off on the basis of the output pulse of the Hall IC or a speed detection signal so that the rotatable tub 4 is maintained at 30 rpm, for example. Water is supplied into the rotatable tub 4 during the low speed operation while water is not supplied into the tub 4 during the high speed operation. The rotational speed of the tub 4 in the high speed operation is set at 1,000 rpm, for example, so that a centrifugal dehydration can be performed.

Figure 8:
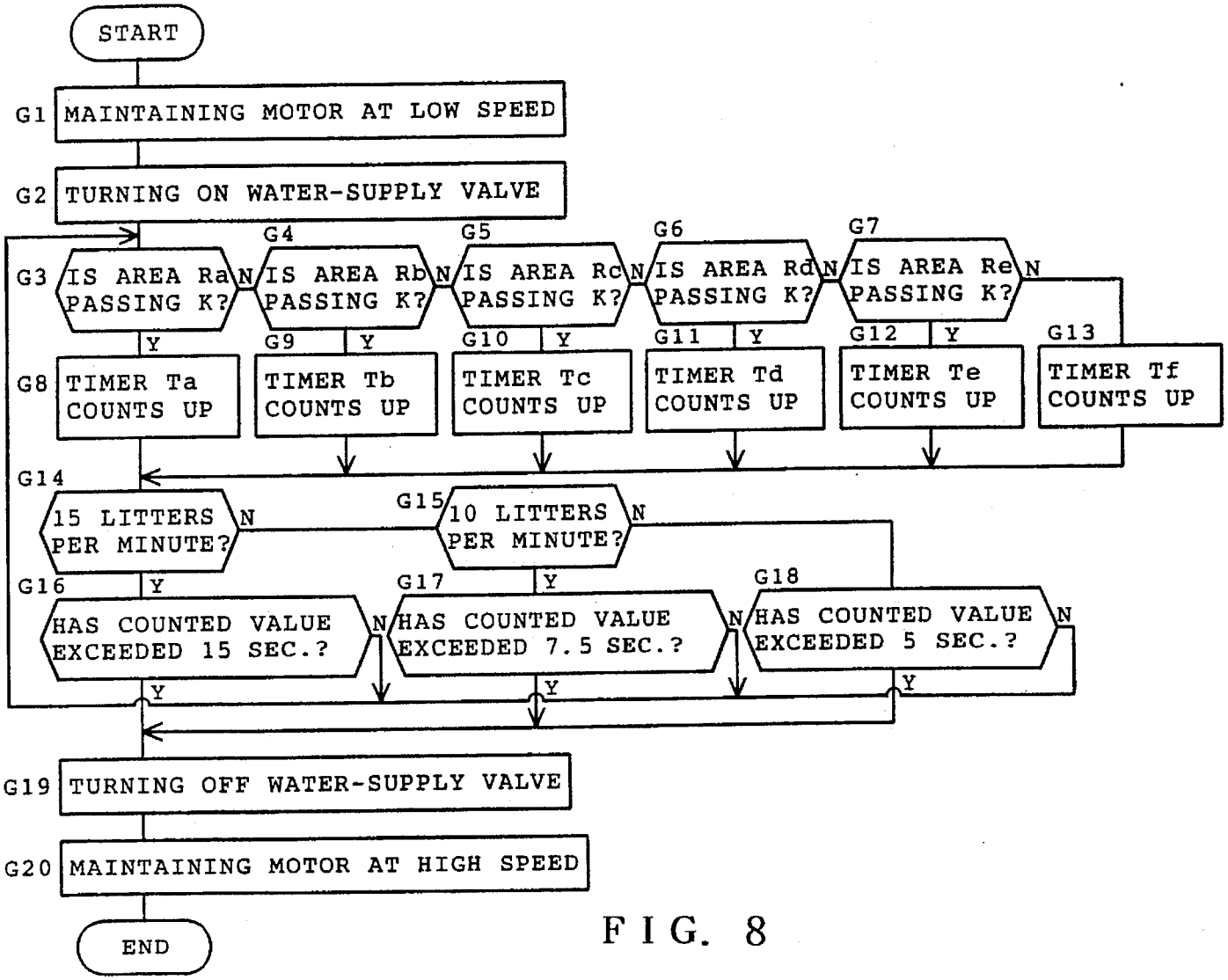
FIG. 8 is a flowchart showing a control manner for the rinse-with-dehydration operation.

A control manner for the rinse-with-dehydration operation in the STANDARD course will be described with reference to FIG. 8. First, the motor 8 is controlled so as to be maintained at the low speed as described above at step G1, which step constitutes a water pouring stage. The water-supply valve 22 is then turned on at step G2 so that water supply is initiated. The control circuit 41 then determines as to which of the set areas Ra-Rf is passing the water pouring location K, at steps G3 to G7. More specifically, at step G3, the control circuit 41 determines as to whether the second pulse has not risen subsequently to the rise of the first pulse, thereby determining as to whether the set area Ra is passing the water pouring location K or not. At step G4, the control circuit 41 determines as to whether the fourth pulse has not risen subsequently to the rise of the third pulse, thereby determining as to whether the set area Rb is passing the water pouring location K or not. The same determination as described above is made in each of steps G5 to G7 with respect to the respective set areas Rc to Rf.

The control circuit 41 advances to step G8 when determining at step G3 that the set area Ra is passing the water pouring location K. At step G8, a software timer function Ta serving as timer means and incorporated in the control circuit 41 counts up by one. When determining at step G4 that the set area Rb is passing the water pouring location K, the control circuit 41 advances to step G9 where a software timer function Tb serving as timer means and incorporated in the control circuit 41 counts up by one. When determining at step G5 that the set area Rc is passing the water pouring location K, the control circuit 41 advances to step G10 where a software timer function Tc serving as timer means and incorporated in the control circuit 41 counts up by one. When determining at step G6 that the set area Rd is passing the water pouring location K, the control circuit 41 advances to step G11 where a software timer function Td serving as timer means and incorporated in the control circuit 41 counts up by one. When determining at step G7 that the set area Re is passing the water pouring location K, the control circuit 41 advances to step G12 where a software timer function Te serving as timer means and incorporated in the control circuit 41 counts up by one. When determining at step G7 in the negative or that the set area Rf is passing the water pouring location K, the control circuit 41 advances to step G13 where a software timer function Tf serving as timer means and incorporated in the control circuit 41 counts up by one.

The software timer functions Ta-Tf accumulate periods of time required for the set areas Ra-Rf to pass the water pouring location K respectively. Accordingly, quantities of water supplied to the set areas Ra-Rf can be determined on the basis of the accumulated time periods respectively.

Subsequently to steps G8–G13, the control circuit 41 specifies the water supply capacity determined as described above into one of "5 litters per minute," "10 litters per minute" and "15 litters per minute" at steps G14 and G15. When specifying the water supply capacity as "5 litters per minute," the control circuit 41 advances to step G16 to determine as to whether the counted values (passing time periods) of all the software timer functions Ta-Tf each have exceeded a reference time period of 15 seconds (corresponding to 1.25 litters of water). When all the counted values have exceeded the reference time period, the control circuit 41 determines that a quantity of water supplied to each of the set areas is sufficient or that a quantity of water received by the laundry in each set area or the hydrous state of the laundry in each set area is satisfactory, then advancing to step G19.

When specifying the water supply capacity as "10 litters per minute," the control circuit 41 advances to step G17 to determine as to whether the counted values (passing time periods) of all the software timer functions Ta-Tf each have exceeded a reference time period of 7.5 seconds (corresponding to 1.25 litters of water). When all the counted values have exceeded the reference time period, the control circuit 41 determines that a quantity of water supplied to each of the set areas is sufficient or that a quantity of water received by the laundry in each set area or the hydrous state of the laundry in each set area is satisfactory, then advancing to step G19.

Furthermore, when specifying the water supply capacity as "15 litters per minute," the control circuit 41 advances to step G18 from step G15 to determine as to whether the counted values (passing time periods) of all the software timer functions Ta-Tf have each exceeded a reference time period of 5 seconds (corresponding to 1.25 litters of water). When all the counted values have exceeded the reference time period, the control circuit 41 determines that a quantity of water supplied to each of the set areas is sufficient or that a quantity of water received by the laundry in each set area or the hydrous state of the laundry in each set area is satisfactory, then advancing to step G19.

The water-supply valve 21 is turned off at step G19 for termination of the water supply and the water pouring stage. The control circuit 41 then advances to step G20 which is in a dehydration stage. At step G20, the motor 8 is full energized so as to be maintained in a high-speed rotation state for a predetermined period of time. The rinse-with-dehydration operation is completed with expiration of the predetermined time period.

According to the above-described embodiment, the control circuit 41 detects the periods required for the respective set areas Ra-Rf to pass the water pouring location K separately, which periods are obtained by the respective software timer functions Ta-Tf. A quantity of water received by the laundry in each set area becomes smaller as the passing time period of each set area is rendered short, while the quantity of water becomes larger as the passing time period is rendered long. Accordingly, the hydrous state of the laundry in each set area is determined on the basis of each of the periods obtained by each software timer function. Consequently, since quantities of water contained in the laundry in the respective set areas are obtained separately, occurrence of the insufficient rinsing in part of the laundry can be prevented.

In the embodiment, particularly, the water supplying operation is stopped when the passing time periods of all the set areas Ra-Rf have each exceeded the reference time period. Consequently, since water is sufficiently supplied to the laundry in each set area, insufficiency in the rinsing can be further prevented.

Furthermore, the water supply capacity of the water supply unit 22 is determined among "5 litters per minute", "10 litters per minute" and 15 litters per minute." The reference time period is changed among "15 seconds," "7.5 seconds" and "5 seconds" according to the determined water supply capacity. Consequently, a quantity of water proper for the rinsing of the laundry can be supplied even when the water supply capacity of the water supply unit 22 is varied.

The rotation detecting means detecting the rotation angle of the rotatable tub 4 should not be limited to the arrangement as shown in FIG. 2. For example, a plurality of detected objects such as permanent magnets may be secured to the outer surface of the rotatable tub 4, and a waterproofed magnetic detector element such as Hall IC may be mounted on the inner surface of the outer tub 2.

Figure 9A:
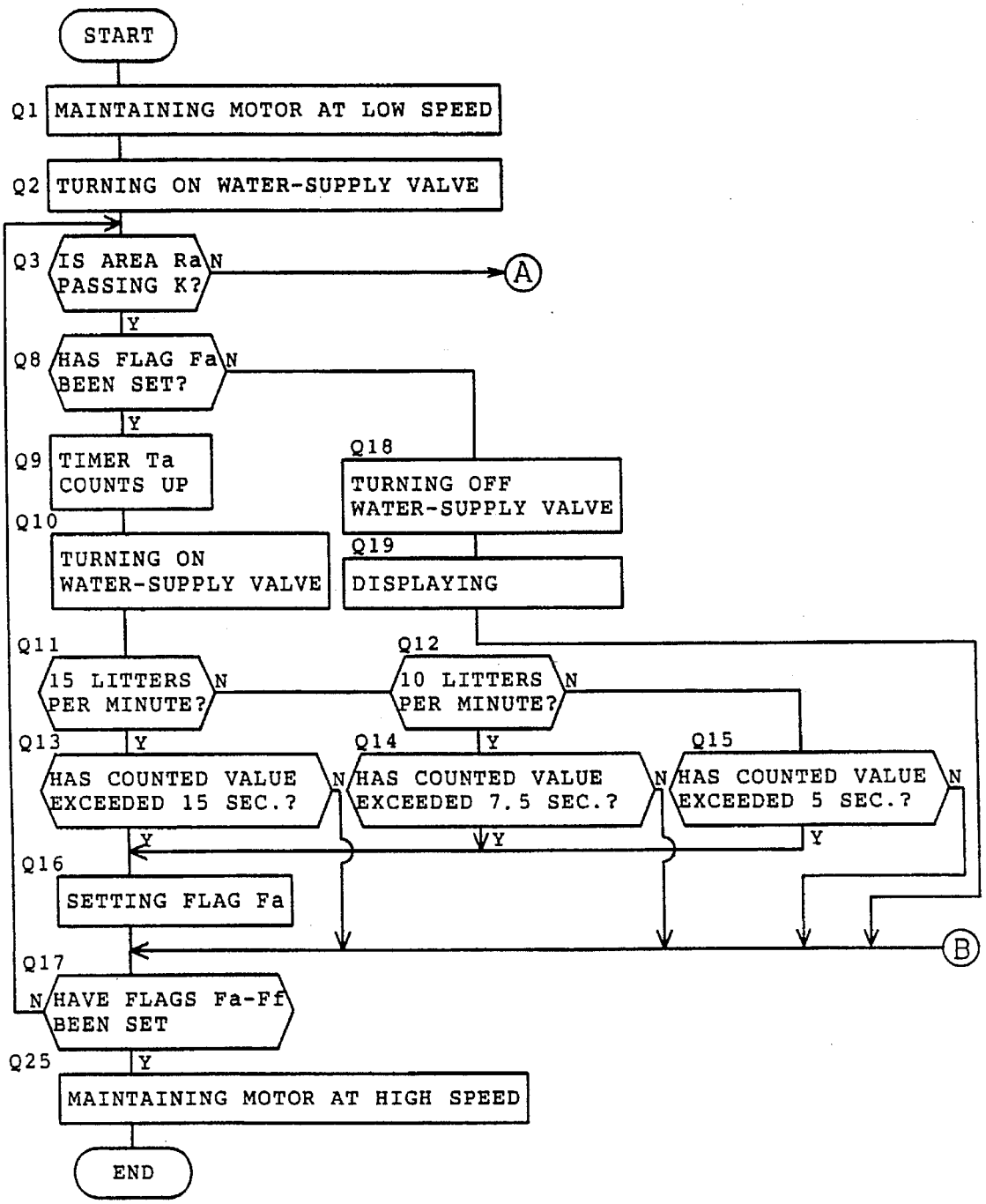
FIG. 9 is a flowchart showing a control manner for the rinse-with-dehydration operation performed by a washing machine of a second embodiment according to the present invention.
Figure 9B:
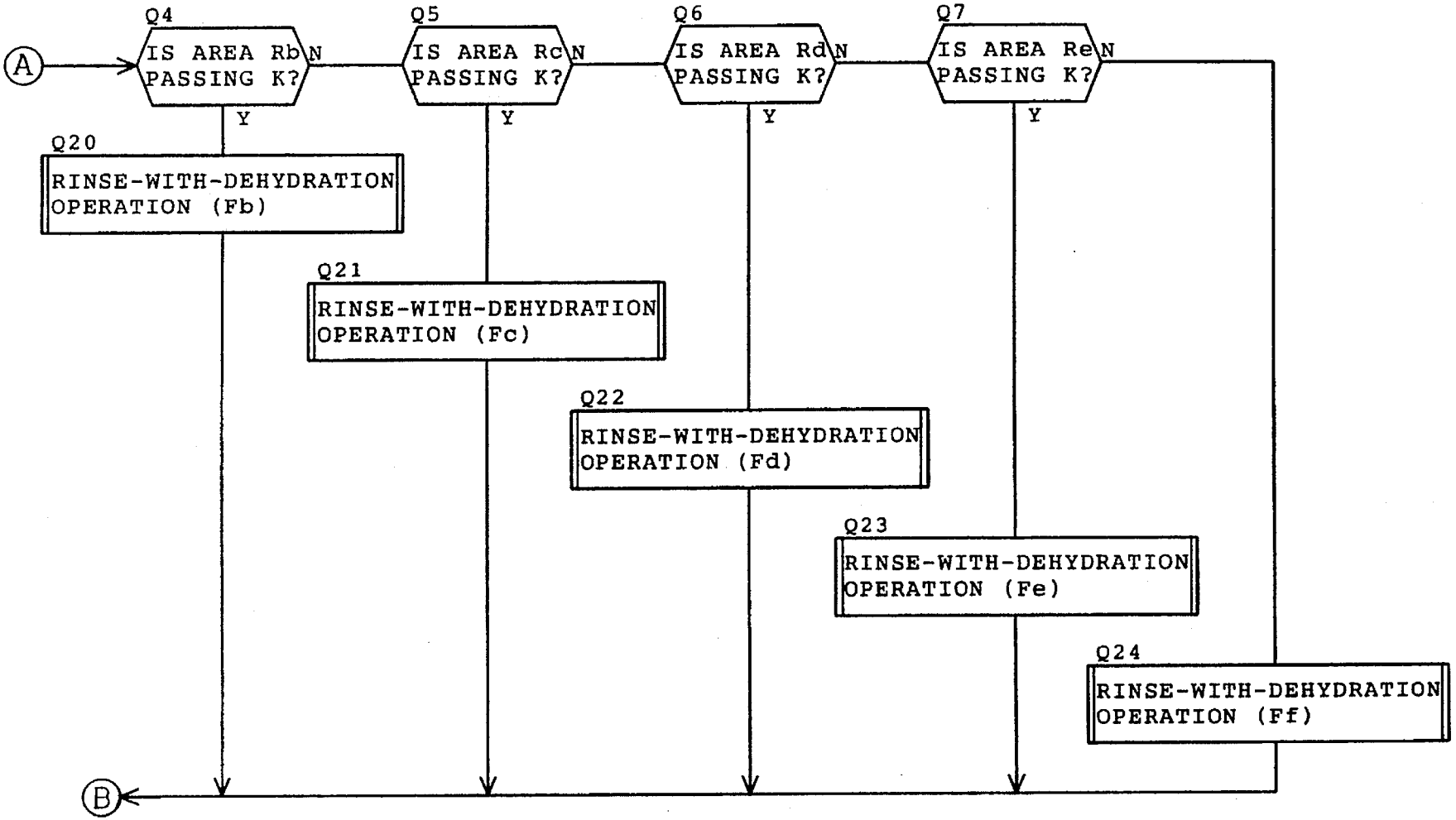

FIG. 9 illustrates a second embodiment of the invention. Differences between the first and second embodiments will be described. Steps Q1 to Q7 in FIG. 9 are identical with steps G1 to G7 in FIG. 8 showing the first embodiment, respectively. For example, when the set area Ra is passing the water pouring location K or when the control circuit 41 determines in the affirmative at step Q3, the control circuit 41 determines at step Q8 as to whether a flag Fa for determination of water-supply completion has been set or not. When the flag Fa has not been set, the software timer function Ta counts up by one (step Q9) and the water-supply valve 21 is turned on (step Q10). Then, the control circuit 41 determines as to whether or not the passing time period obtained by the software timer function Ta has exceeded the reference time period according to the determined water supply capacity, at steps Q11 to Q15 which are identical with respective steps G14 to G18.

The control circuit 41 advances to step Q17 without execution of step Q16 when the passing time period obtained by the software timer function Ta has not exceeded the reference time period according to the determined water supply capacity. At step Q17, the control circuit 41 determines as to whether all the flags Fa to Ff have been set or not. The flags Fb to Ff will be described later. The control circuit 41 returns to step Q3 when any one of the flags Fa-Ff has not been set.

The control circuit 41 advances to step Q16 where the flag Fa is set when determining in the affirmative at any one of steps Q13, Q14 and Q15 or when the passing time period obtained by the software timer function Ta has exceeded the reference time period according to the determined water supply capacity. Thereafter, the control circuit 41 further advances to steps Q8 via steps Q17 and Q3. When determining at step Q8 that the flag Fa has been set, the control circuit 41 advances to step Q18, where the water-supply valve 21 is turned off. More specifically, the water supply to the set area Ra is stopped when a quantity of water supplied to the area Ra has reached a sufficient quantity (1.25 litters). The control circuit 41 subsequently advances to step Q19 where the display 26*a* of the display section 26 corresponding to the set area Ra is turned on or lighted.

The above-described control is performed also when each of the other set areas Rb to Rf is passing the water pouring location K. More specifically, the rinse-with-dehydration control step Q20 including the same steps as those Q8 to Q16, Q18 and Q19 is executed when the set area Rb is passing the water pouring location K or when the control circuit 41 determines in the affirmative at step Q4. The flag Fb is employed for determination of the water-supply completion in the rinse-with-dehydration control. The rinse-with-dehydration control step Q21 in which the flag Fc is employed for determination of the water-supply completion is executed when the set area Rc is passing the water pouring location K or when the control circuit 41 determines in the affirmative at step Q5. The rinse-with-dehydration control step Q22 in which the flag Fd is employed for determination of the water-supply completion is executed when the set area Rd is passing the water pouring location K or when the control circuit 41 determines in the affirmative at step Q6. The rinse-with-dehydration control step Q23 in which the flag Fe is employed for determination of the water-supply completion is executed when the set area Re is passing the water pouring location K or when the control circuit 41 determines in the affirmative at step Q7. The rinse-with-dehydration control step Q24 in which the flag Ff is employed for determination of the water-supply completion is executed when the set area Rf is passing the water pouring location K or when the control circuit 41 determines in the negative at step Q7.

The water-supply valve 21 is thus turned on and off for each of the set areas Ra-Rf. When the passing time period of each set area has exceeded the reference time period, the water supply to the area is stopped and one of the display sections 26*a* to 26*f* corresponding to the area is lighted. The control circuit 41 advances to step Q25 when determining at step Q17 that all the flags Fa to Ff have been set. At step Q25, the motor 8 is full energized to be rotated at a high speed and maintained at the speed for the predetermined period of time as in step G20 in FIG. 8. Subsequently, the rinse-with-dehydration operation is completed.

According to the second embodiment, the water supply to the set areas whose passing time periods have each exceeded the reference time period is stopped successively. Thus, since a quantity of water supplied to each set area is rendered minimum, insufficiency in the rinsing of laundry can be prevented and yet, a quantity of water used for the rinsing can be controlled to its minimum.

Furthermore, the display sections 26*a* to 26*f* of the area display section 26 are lighted when the passing time periods of the respective set areas Ra to Rf have each passed the reference time period. This provides for convenience because the user can get information about the completion of water supply. All the display sections 26*a*–26*f* may be turned on beforehand and may be successively turned off when the corresponding areas have exceeded the reference time period.

Figure 10:
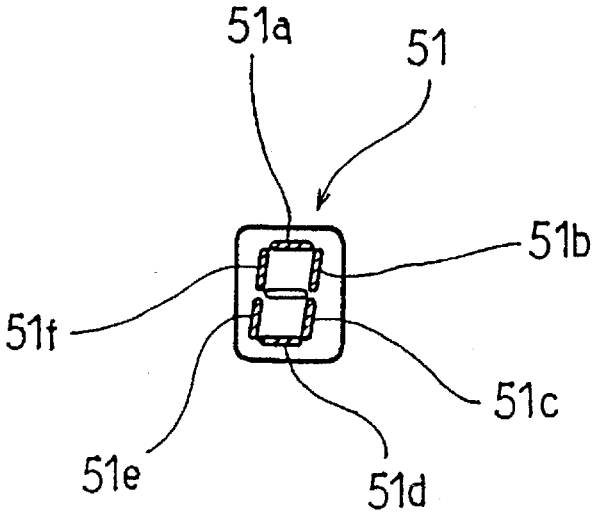
FIG. 10 is a top plan view of a display employed in a washing machine of a third embodiment according to the present invention.

Although the time and step display 25 and the area display 26 are separately provided in the foregoing embodiments, one segment of the time and step display 25 may be used for the area display 26 as shown as a third embodiment in FIG. 10. A seven-segment type area display 51 has six displaying elements 51*a* to 51*f* which serve as the display sections respectively in the third embodiment.

Furthermore, a flow meter may be provided for detecting the water supply capacity. Additionally, the number of areas set in the rotatable tub 4 should not be limited to six. Four areas may be set in the tub 4. In this case, the rotation angle of the tub 4 is detected at intervals of 90 degrees.

FIGS. 11 to 15 illustrate a fourth embodiment of the invention. In the washing machine of the fourth embodiment, the interior of the dehydrating tub is divided into four equal set areas and the area display 26 has four equally divided display sections accordingly. The area display 26 further serves to monitor rotation of the agitator and the dehydrating tub as will be described later. Since the rinse-with-dehydration operation is performed in the fourth embodiment in the same manner as described above, the description is eliminated.

Figure 11:
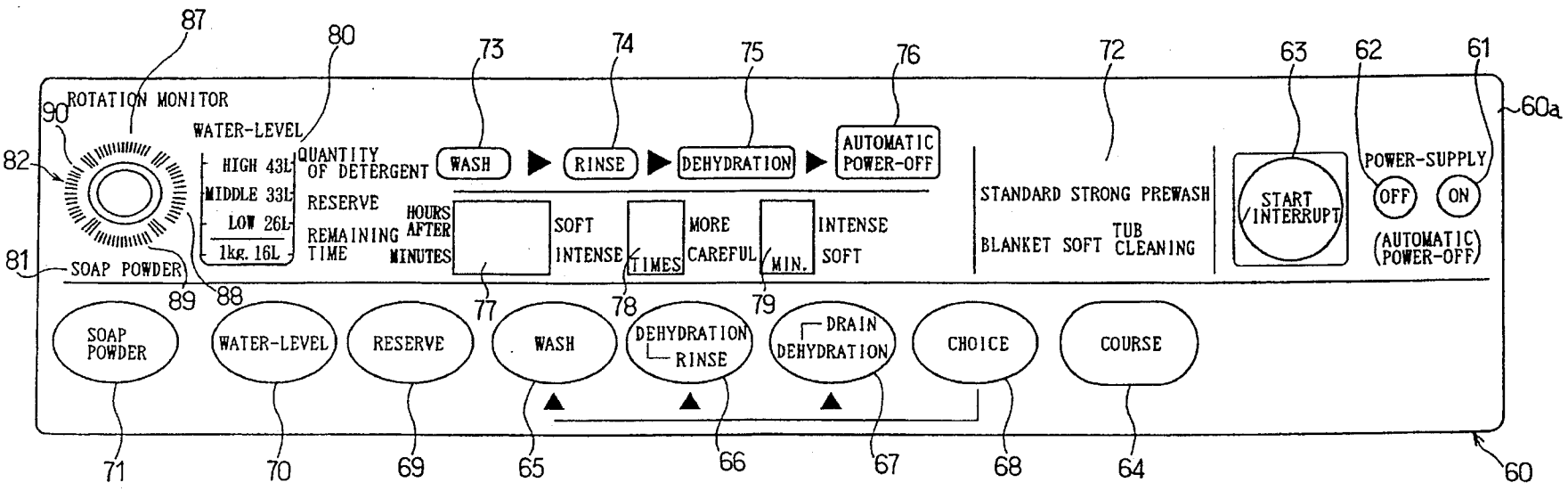
FIG. 11 is a top plan view of an operation panel of a washing machine of a fourth embodiment according to the present invention.
Figure 12:
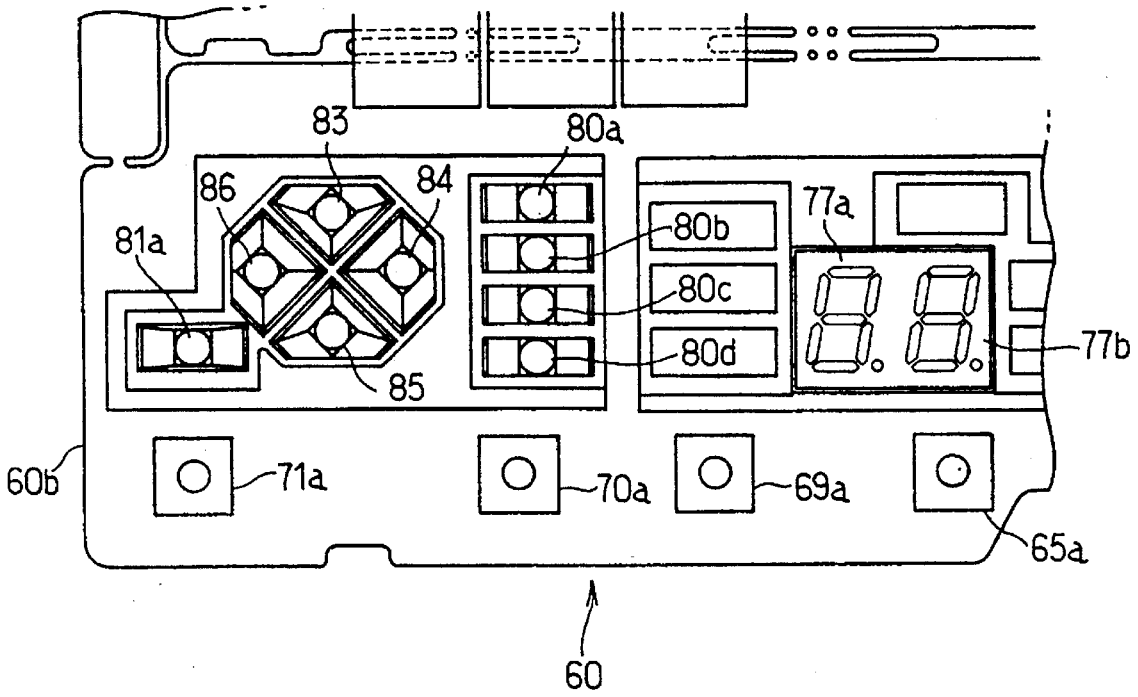
FIG. 12 shows an arrangement of light-emitting diodes on the operation panel with an elastic sheet eliminated.

Referring to FIG. 11, an operation panel 60 of the washing machine includes various key switches 61 to 71 and various display sections 72 to 81. A WASH step selecting key switch 65 is provided for setting a desired washing period of time, a RINSE selecting key switch 66 for setting the desired number of times of the rinsing operation, and a DEHYDRATION selecting key switch 67 for setting a desired dehydrating period of time. The contents set by these key switches are displayed on a TIME display section 77, a NUMBER OF TIMES display section 78, and a TIME display section 79 respectively. Steps in execution are displayed sequentially on STEP display sections 73 to 75 after start of the washing operation. The water level selected by the WATER-LEVEL selecting key switch 70 is displayed on a WATER-LEVEL display section 80.

A washing start time can be reserved by operation of a RESERVE key switch 69 in the washing machine of the embodiment. A reserved time period between the current time and a desired washing start time is set to be displayed on the TIME display section 77. Furthermore, a washing period of time can be set in the unit of minutes in accordance with a quantity of laundry in the washing machine of the embodiment as will be described later. The washing time period is displayed on the TIME display section 77 and decremented in one minute with progress of the washing operation.

Figure 13:
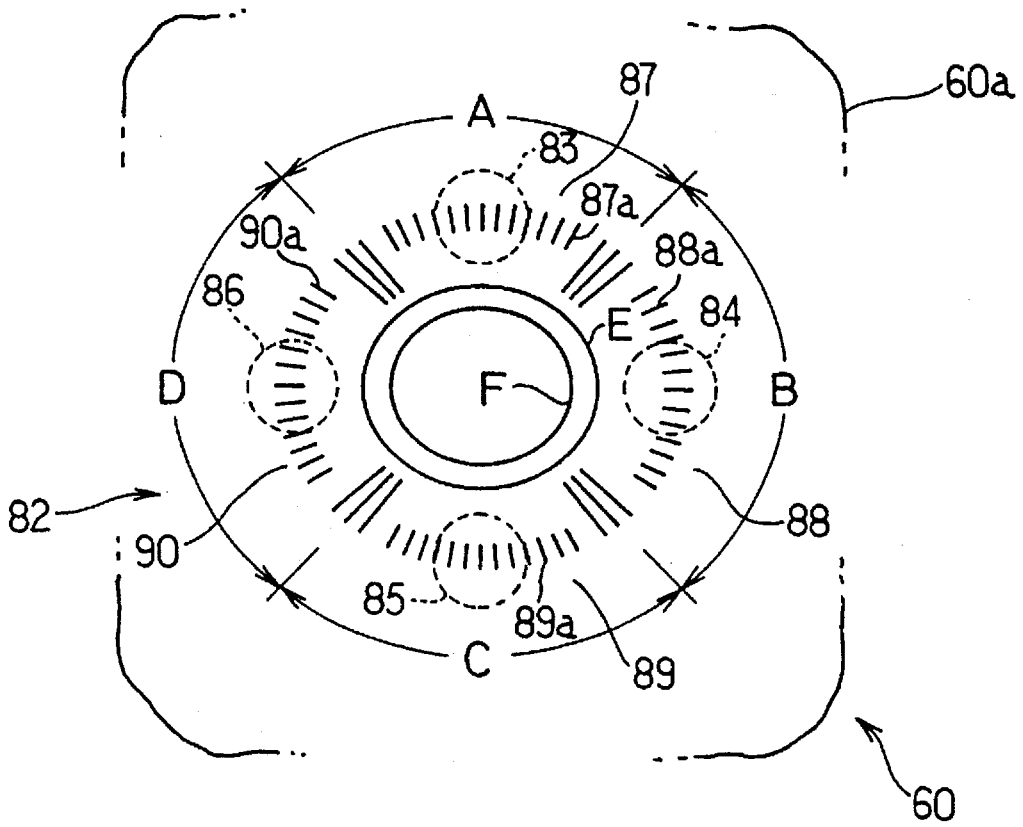
FIG. 13 is an enlarged view of a rotation monitor on the operation panel.

A rotation monitor 82 serving as a display section is provided in the operation panel 60 for displaying the rotational state of the dehydrating tub 4 and the agitator 5 and for displaying the hydrous state of the laundry in each set area of the tub 4 as in the first embodiment. The rotation monitor 82 comprises a plurality (four in the embodiment) of light-emitting diodes 83 to 86 which are arranged to form a rhombus as shown in FIG. 13. The rotation monitor 82 is disposed on the backside of a resin sheet 60*a* composing a surface (panel face) of the operation panel 60 or on a board 60*b* covered by the resin sheet 60*a*. Reference symbols 65*a*, 69*a*, 70*a* and 71*a* in FIG. 12 designate switch elements of the WASH step selecting key switch 65, a RESERVING key switch 69, a WATER-LEVEL selecting key switch 70 and SOAP POWDER key switch 71 respectively. Reference symbols 77*a* and 77*b* designate seven-segment type light-emitting diodes composing the TIME display section 77 respectively. Reference symbols 80*a*, 80*b*, 80*c* and 80*d* designate light-emitting diodes of the WATER-LEVEL display section 80 for displaying water levels respectively. Reference symbol 81*a* designates a light-emitting diode of the SOAP POWDER display section 81.

The resin sheet 60*a* includes first to fourth light transmitting portions 87 to 90 which are formed in portions illuminated by the light-emitting diodes 83 to 86 and which are shown by ranges A to D in FIG. 13, respectively. The light transmitting portions 87 to 90 has transparent or translucent line portions 87*a* to 90*a* respectively so that light emitted by the light-emitting diodes 83 to 86 is radiated outwardly through the respective light transmitting portions 87 to 90. The line portions 87*a* to 90*a* constituting the respective light transmitting portions 87 to 90 each have the shape of an arc and are arranged into an oval shape. Double oval lines E and F are displayed on the central portions of the light transmitting portions 87 to 90.

The operation of the washing machine thus constructed will now be described. The POWER-ON key switch 61 is first operated and then, the desired key switches are operated. Subsequently, upon depression of the START/INTERRUPT key switch 53, the control circuit 41 comprising a microcomputer executes detection of a quantity of cloth or laundry. In the detection of the laundry quantity, the motor 8 is energized to repeat the cycle of forward rotation, stop and reverse rotation. The Hall IC 32 generates pulses whose number is in accordance with the motor speeds during the forward rotation, inertial rotation subsequent to interrupt, reverse rotation, and inertial rotation subsequent to interrupt. Load applied to the motor 8 becomes larger as the quantity of laundry becomes large. Accordingly, the motor speed is not increased and a time period of the inertial rotation is shortened. The number of pulses generated by the Hall IC 32 becomes smaller as the cloth quantity becomes small. Consequently, the control circuit 41 determines the quantity of laundry based on the number of pulses generated by the Hall IC 32. Based on the results of determination, the control circuit 41 sets the water level and the set water level is displaced on the WATER-LEVEL display section 80 when the water-level is not manually set. At the same time, the control circuit 41 obtains a required washing time period and the obtained washing time period is displayed on the TIME display section 77.

Upon completion of the laundry quantity detection, the control circuit 41 initiates the washing operation including steps of wash, rinse and dehydration. Since the contents of the washing operation are well known in the art, they will not be described in detail. A manner for controlling the rotation monitor 82 displaying the rotational state of the dehydrating tub 4 and the agitator 5 will be described hereinafter with reference to FIGS. 14 and 15.

The water-supply valve 21 is turned on so that water is supplied into the dehydrating tub 4 until reaching the set water-level. Subsequently to the water-supply, the wash step is executed. In the wash step, the motor 8 is rotated alternately in the forward or clockwise and reverse or counter-clockwise directions repeatedly so that the agitator 5 is rotated accordingly. All the light-emitting diodes 83–86 of the rotation monitor 82 are turned off until the wash step is initiated or while the agitator 5 is stationary. Upon initiation of the wash step, the light-emitting diodes 83–86 of the rotation monitor 82 are sequentially lighted according to the control routine for the rotation monitor as shown in FIG. 14.

Figure 14A:
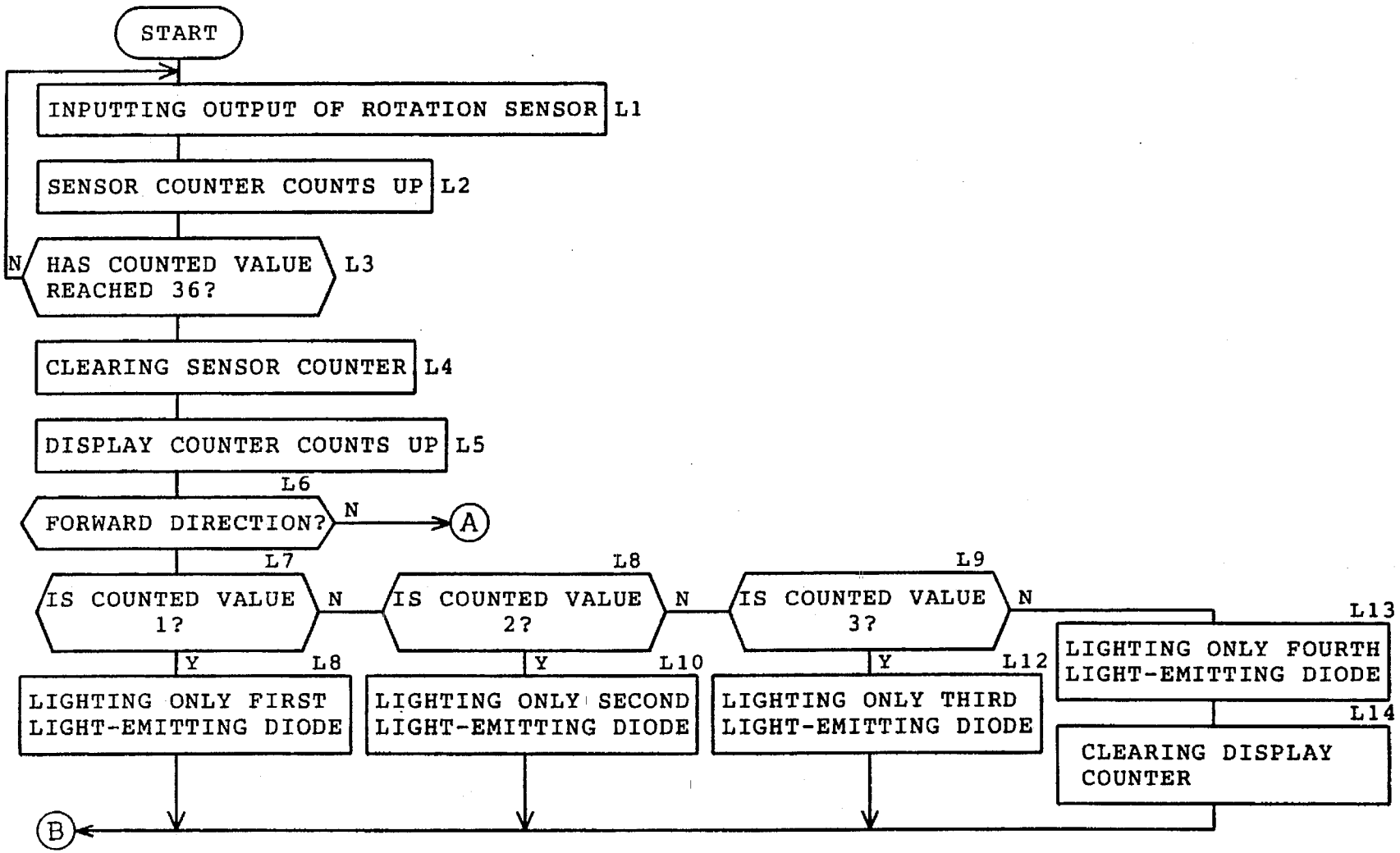
FIG. 14 is a flowchart showing a control manner for the rotation monitor in wash and rinse steps.
Figure 14B:
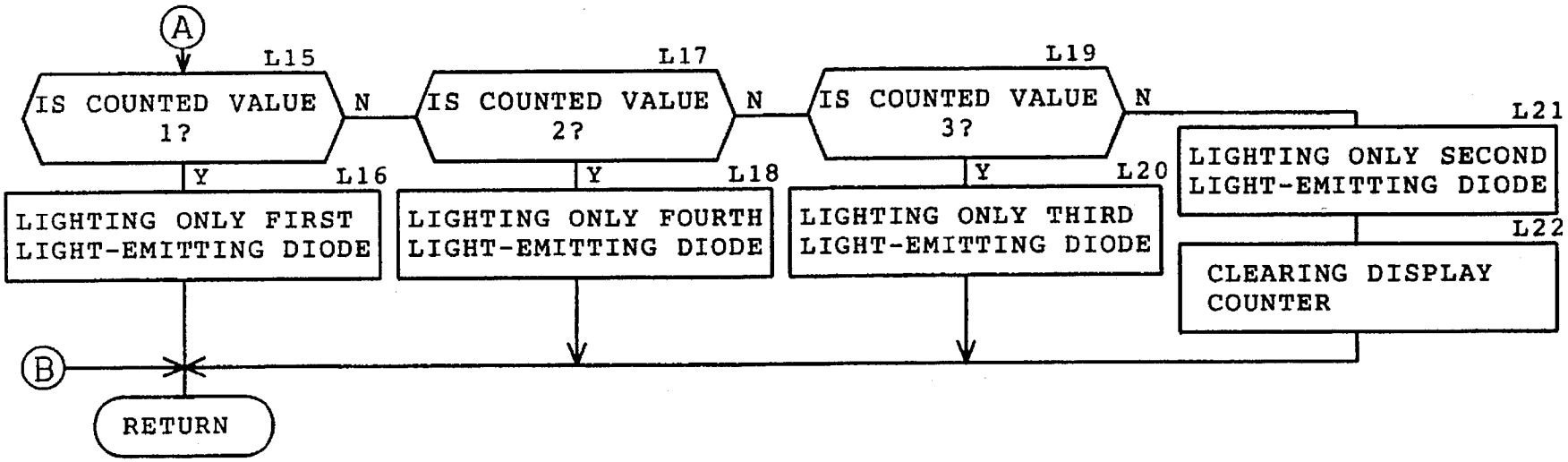

Referring to FIG. 14, the control circuit 41 inputs the output pulses of the Hall IC 32. A sensor counter (not shown) incorporated in the control circuit 41 counts up by one per pulse input. The counting operation of the sensor counter is continued until its counted value reaches "36" (repetition of steps L1 to L3). The control circuit 41 determines in the affirmative at step L3 when the counted value of the sensor counter has reached "36." The counted value of the sensor counter is cleared at step L4 and the display counter counts up by one at step L5. The control circuit 41 then advances to step L6 where the rotational direction of the motor 8 is determined on the basis of the output of the Hall IC 32. The control circuit 41 advances to step L7 when determining that the motor 8 is being rotated in the forward direction. When determining at step L6 that the motor 8 is being rotated in the reverse direction, the control circuit 41 advances to step L15. At step L7, the control circuit 41 determines as to whether the counted value of the display counter is "1" or not. When the counted value is "1," the control circuit 41 advances to step L8 where only the first light-emitting diode 83 is lighted.

Subsequently, at every time of execution of the control routine as shown in FIG. 14, the display counter counts up by one when the counted value of the sensor counter has reached "36." When determining in the negative at step L7, the control circuit 41 advances to step L9. When the counted value of the display counter is "2," the control circuit 41 advances to step L10 where only the second light-emitting diode 84 is flashed. The control circuit 41 advances to step L11 when determining in the negative at step L9. When the counted value of the display counter is "3," the control circuit 41 advances to step L12 where only the third light-emitting diode 85 is flashed. When determining in the negative at step L11, the control circuit 41 advances to step L13 where only the fourth light-emitting diode 86 is flashed. Accordingly, the light-emitting diodes 83–86 are sequentially flashed so that the flashing proceeds in the clockwise direction. Subsequently to execution of step L13, the control circuit 41 advances to step L14 where the counted value of the display counter is cleared. Thereafter, the display counter counts up from "1" again. Consequently, the first to fourth light-emitting diodes 83–86 are sequentially flashed for a short period of time in the clockwise direction which is the same as that of the agitator 5, when the motor 8 is in its forward rotation period.

On the other hand, the control circuit 41 advances from step L6 to step L15 when the motor 8 is being rotated in the reverse or counterclockwise direction. When the counted value of the display counter is "1" at step L15, the control circuit 41 advances to step L16 where only the first light-emitting diode 83 is flashed. Subsequently, the display counter counts up every time the control routine as shown in FIG. 14 is executed. When determining in the negative at step L15, the control circuit 41 advances to step L17 where whether the counted value is "2" or not is determined. When the counted value is "2," the control circuit 41 advances to step L18 where only the fourth light-emitting diode 86 is flashed. When determining in the negative at step L17, the control circuit 41 advances to step L19. When the counted value is "3" at step L19, the control circuit 41 advances to step L20 where only the third light-emitting diode 85 is flashed. The control circuit 41 advances to step L21 to flash only the second light-emitting diode 84 when determining in the negative at step L19. Accordingly, the light-emitting diodes 83–86 are sequentially flashed so that the flashing proceeds in the counterclockwise direction. Subsequently to execution of step L21, the control circuit 41 advances to step L22 where the counted value of the display counter is cleared. Thereafter, the display counter counts up from "1" again. Consequently, the first, fourth, third and second light-emitting diodes 83, 86, 85 and 84 are sequentially flashed for respective short periods of time so that the flashing is looped in the counterclockwise direction which is the same as that of the agitator 5, when the motor 8 is in its reverse rotation period.

The flashing time period of each light-emitting diode is equal to a period in which the sensor counter counts up to "36." Accordingly, the flashing period becomes shorter as the rotational speed of the motor 8 is increased. The flashing of the light-emitting diodes thus proceeds at the speed corresponding to the rotational speed of the motor 8 or the agitator 5.

Figure 15:
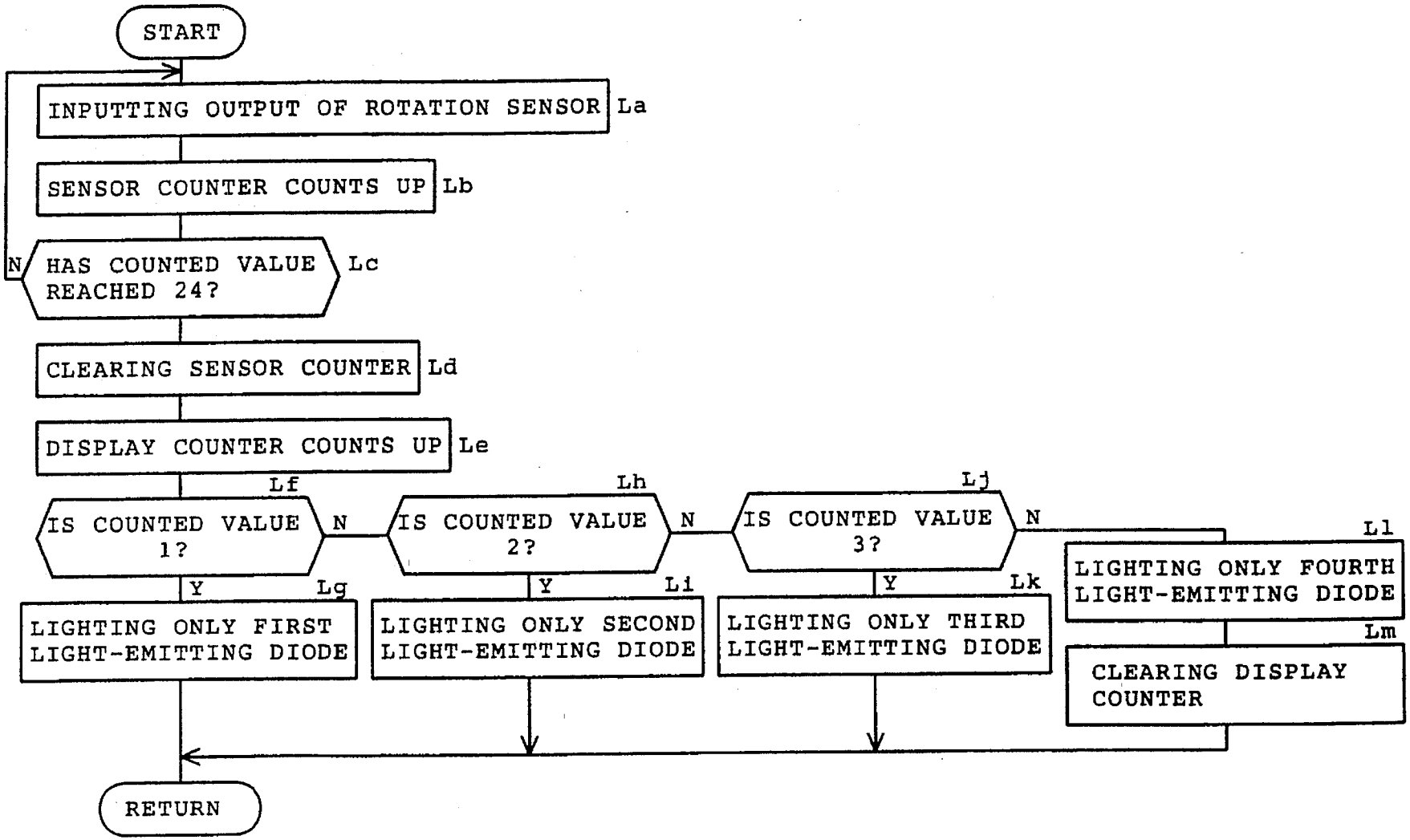
FIG. 15 is a flowchart showing a control manner for the rotation monitor in a dehydration step.

The motor 8 is rotated in the forward direction at an initial stage of the rinse step and in the dehydration step after the water has been discharged out of the water-receiving tub 3. The motor 8 thus rotates the dehydrating tub 4 in the clockwise direction so that the dehydrating operation is performed. All the light-emitting diodes 83–86 of the rotation monitor 82 are turned off while rotation of the agitator 5 and the dehydrating tub 4 is stopped in the wash and dehydration steps. Upon start of the dehydrating operation, the control circuit 41 executes a rotation monitor control routine as shown in FIG. 15 so that the light-emitting diodes 83–86 are sequentially flashed for the respective short periods of time to thereby display the rotational state of the dehydrating tub 4. Assume now that the motor 8 is rotated in the forward direction with start of the dehydrating operation, thereby rotating the dehydrating tub 4 in the clockwise direction.

Referring to FIG. 15, the control circuit 41 inputs the output pulses of the Hall IC 32. The sensor counter counts up by one per pulse input. The counting operation of the sensor counter is continued until its counted value reaches "24" (repetition of steps La to Lc). The control circuit 41 determines in the affirmative at step Lc when the counted value of the sensor counter has reached "24." The counted value of the sensor counter is cleared at step Ld and the display counter counts up by one at step Le. The control circuit 41 then advances to step Lf to determine as to whether the counted value of the display counter is "1" or not. When the counted value is "1," the control circuit 41 advances to step Lg where only the first light-emitting diode 83 is flashed.

Subsequently, at every time of execution of the rotation monitor control routine as shown in FIG. 15, the display counter counts up by one when the counted value of the sensor counter has reached "24." When determining in the negative at step Lf, the control circuit 41 advances to step Lb. When the counted value of the display counter is "2," the control circuit 41 advances to step Li where only the second light-emitting diode 84 is flashed. The control circuit 41 advances to step Lj when determining in the negative at step Lh. When the counted value of the display counter is "3," the control circuit 41 advances to step Lk where only the third light-emitting diode 85 is flashed. When determining in the negative at step Lj, the control circuit 41 advances to step L1 where only the fourth light-emitting diode 86 is flashed. Accordingly, the light-emitting diodes 83–86 are sequentially flashed. Subsequently to execution of step L1, the control circuit 41 advances to step Lm where the counted value of the display counter is cleared. Thereafter, the display counter counts up from "1" again. Consequently, the first to fourth light-emitting diodes 83–86 are sequentially flashed for the respective short periods of time so that the flashing is looped in the clockwise direction which is the same as that of the dehydrating tub 4, while the dehydrating operation is being performed.

The flashing time period of each light-emitting diode is equal to a period in which the sensor counter counts up to "24." Accordingly, the flushing of the light-emitting diodes 83–86 proceeds at a higher speed in the dehydrating operation than in the washing operation even if the rotational speed of the motor 8 in the dehydrating operation is the same as in the washing operation. This squares with the fact that the rotational speed of the motor 8, which is rotated at a higher speed than the agitator 5 rotated in the washing operation, is higher in the dehydrating operation than in the washing operation because rotation of the motor 8 is transmitted to the dehydrating tub 4 with the reduction ratio being rendered lower in the dehydrating operation than in the washing operation. Consequently, the rotational state of the dehydrating tub 4 in the dehydrating operation can be indicated more exactly by the proceeding flashing of the first to fourth light-emitting diodes 83–86. On the other hand, in the rinse-with-dehydration operation, the same control as shown in FIG. 8 is executed in a water pouring stage. More specifically, the hydrous state of laundry in each of the four set areas is displayed by consecutively lighting the light-emitting diodes 83–86 while the rotational state of the dehydrating tub 4 is displayed by sequentially lighting the light-emitting diodes.

The first to fourth light-emitting diodes 83–86 are sequentially lighted in each of the wash and dehydration steps in the manner as described above. Light emitted by the light-emitting diodes 83–86 is radiated outwardly through the line portions **87*a*–90*a* of the light transmitting portions 87–90 respectively. Accordingly, the light transmitting portions 87–90 emitting light are looped during rotation of the dehydrating tub 4 or the agitator 5**.

According to the fourth embodiment, all the light-emitting diodes 83–86 are turned off during stop of the dehydrating tub 4 or the agitator 5 in the wash and dehydration steps. Consequently, stop of the dehydrating tub 4 and the agitator 5 can be easily confirmed. The prior art has provided an arrangement that any one of the light-emitting diodes 83–86 is turned off during stop of the dehydrating tub or the agitator with the others being lighted or flashed. This prior art arrangement may cause the user to doubt whether the light-emitting diode turned off is out of order. However, since all the light-emitting diodes are turned off in the above-described embodiment of the present invention, there is no possibility that the user has such doubts.

Furthermore, the first to fourth light-emitting diodes 83–86 are sequentially turned on in each of the wash and dehydration steps, so that the light transmitting portions 87–90 emitting light are looped. Consequently, the user can visually confirm rotation of either the dehydrating tub 4 or the agitator 5 easily. Since the looping speed of the light-emitting diodes turned on or of the light transmitting portions emitting light is higher during rotation of the dehydrating tub 4 than during rotation of the agitator 5, which of the dehydrating tub 4 or the agitator 5 is being rotated can be confirmed by the user on the basis of the looping speed of the light transmitting portions emitting light.

Moreover, the light transmitting portions emitting light are looped and accordingly, the user's attention is spontaneously directed to the looping light. Since oversights in checking as to which of the dehydrating tub or the agitator is being rotated can be reduced, whether it is a suitable time for laundry to be added or not can be determined easily and properly after start of the washing operation when the laundry is added into that previously put into the tub after start of the washing operation. Additionally, an inner lid 13 can be prevented from being inadvertently opened.

Furthermore, the line portions **87*a*–90*a* of the first to fourth light transmitting portions 87–90 are arranged into the oval shape. When the light transmitting portions emitting light are looped, it seems to the user that the light emitting portion is revolving. Consequently, since rotation of the dehydrating tub 4 or the agitator 5** is displayed straightforwardly, rotation of these members can be confirmed intuitively.

The looping speed of the light transmitting portions emitting light corresponds to the rotational speed of the dehydrating tub 4 or the agitator 5. The direction in which the light emitted by the light transmitting portions is looped also corresponds to the rotational direction of the dehydrating tub 4 or the agitator 5. Consequently, the rotational speed and direction of the dehydrating tub 4 or the agitator 5 can be properly grasped although the inner lid 13 keeps the dehydrating tub 4 and the agitator 5 from sight. The rotation monitor 82 thus provides for a high level of monitorability. Additionally, since the rotation monitor 82 comprises the four light-emitting diodes 83–86 and the resin sheet **60*a* having the first to fourth light transmitting portions 87–90, the rotation monitor 82** has a simple construction and can be made at low cost.

Figure 16:
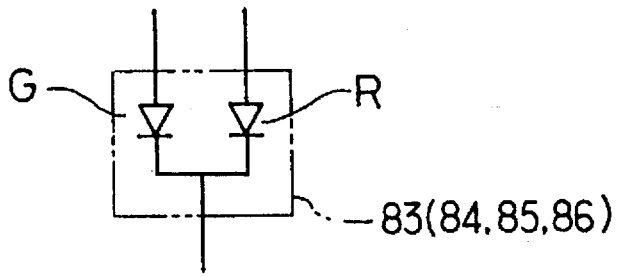
FIG. 16 shows an arrangement of light-emitting diodes employed in a washing machine of a fifth embodiment according to the present invention.

FIG. 16 illustrates a fifth embodiment of the present invention. Light-emitting diodes 83–86 emitting light of a plurality of colors (light of two colors in the embodiment, for example, green light and red light) are employed in the fifth embodiment. Each of the light-emitting diodes 83–86 comprises a light-emitting diode R emitting red light and a light-emitting diode G emitting green light. The green and red lights emitted by the respective light-emitting diodes R and G are mixed together into an orange light.

The light-emitting diodes G of the first to fourth light-emitting diodes 83–86 are sequentially lighted when the agitator 5 or the dehydrating tub 4 is rotated in the wash step. Both light-emitting diodes R and G of the respective light-emitting diodes 83–86 are sequentially lighted when the agitator 5 or the rotatable tub 4 is rotated in the rinse step. The light-emitting diodes R of the first to fourth light-emitting diodes 83–86 are sequentially lighted when the dehydrating tub 4 is rotated in the dehydration step. Accordingly, the first to fourth light-emitting diodes 83–86 or the light-emitting portions are looped in the wash step, emitting the green light. In the rinse step, the light-emitting diodes or the light-emitting portions are looped, emitting the orange light. In the dehydration step, the light-emitting diodes or the light-emitting portions are looped, emitting the red light. Consequently, the user can confirm the step in execution when viewing the rotation monitor 82 without viewing the STEP display sections 73–75.

Figure 17:
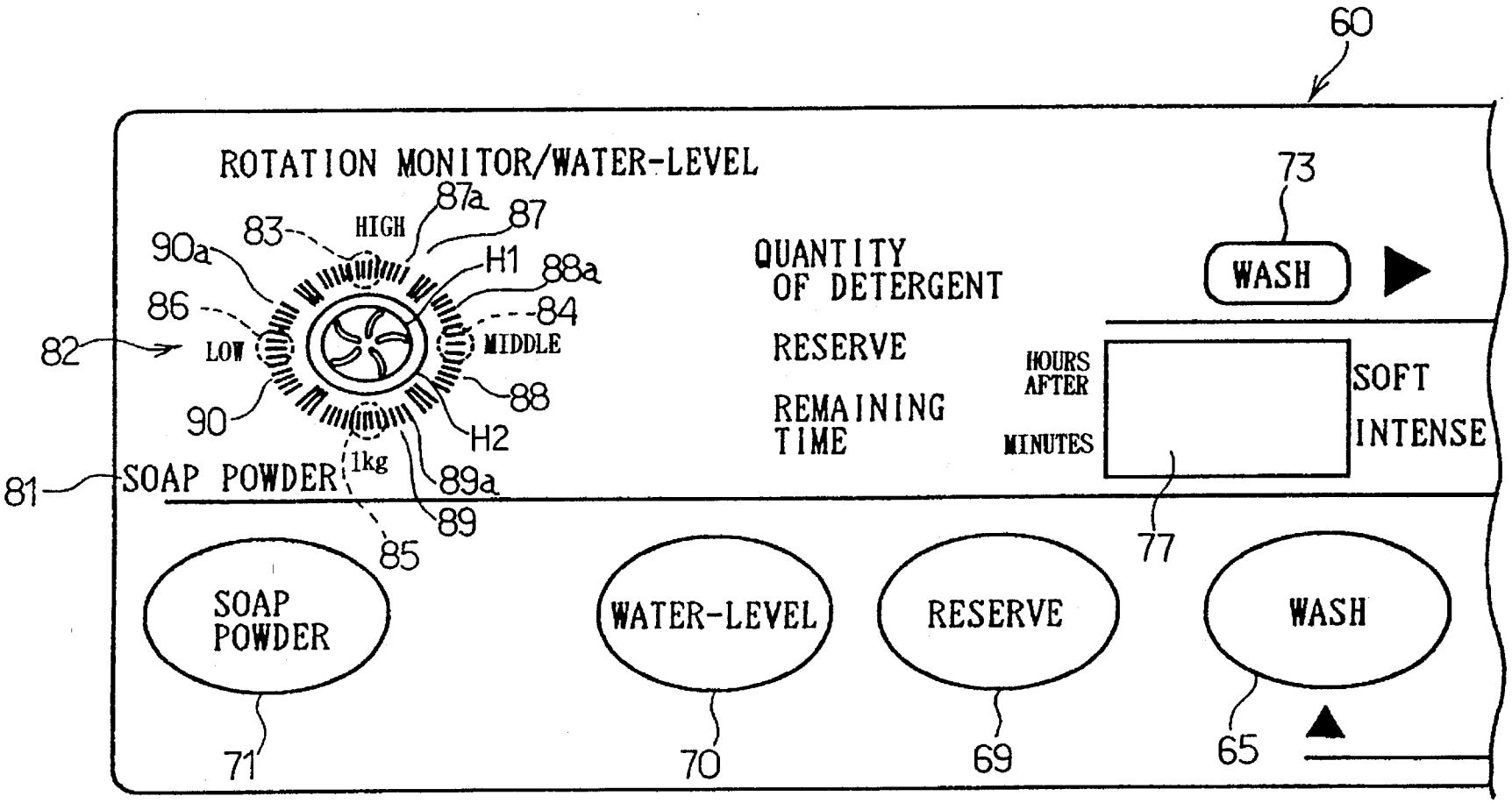
FIG. 17 is a partial flat view of an operation panel of a washing machine of a sixth embodiment according to the present invention.

FIG. 17 illustrates a sixth embodiment of the invention. The identical parts are labeled by the same reference numerals as in the fourth embodiment shown in FIG. 12. The differences between the fourth and six embodiments will be described. First, a figure H1 imitating the agitator 5 is displayed on the center of the rotation monitor 82, and the figure H1 is encircled by an oval line H2. The figure H1 stands for the agitator 5 and the oval line H2 for the dehydrating tub 4, so that the rotation monitor 82 can be readily understood to display the rotational state of the dehydrating tub 4 or the agitator 5.

Second, the WATER-LEVEL display section 80 as employed in the first embodiment is eliminated in the six embodiment, and the rotation monitor 82 also serves as the water-level display section. Indications, "HIGH," "MIDDLE," "1 Kg," and "LOW," for displaying the water levels are provided outside the line portions **87*a*–90*a* of the first to fourth light transmitting portions 87–90. The first light-emitting diode 83 is lighted when the water level is set at "HIGH." The second light-emitting diode 84 is lighted when the water level is set at "MIDDLE." The fourth light-emitting diode 86 is lighted when the water level is set at "LOW." The third light-emitting diode 85** is lighted when a quantity of laundry is 1 Kg. The indication, "1 Kg," stands for 16 litters of water. Since a separate water-level display section need not be provided, the manufacturing cost can be reduced.

Figure 18:
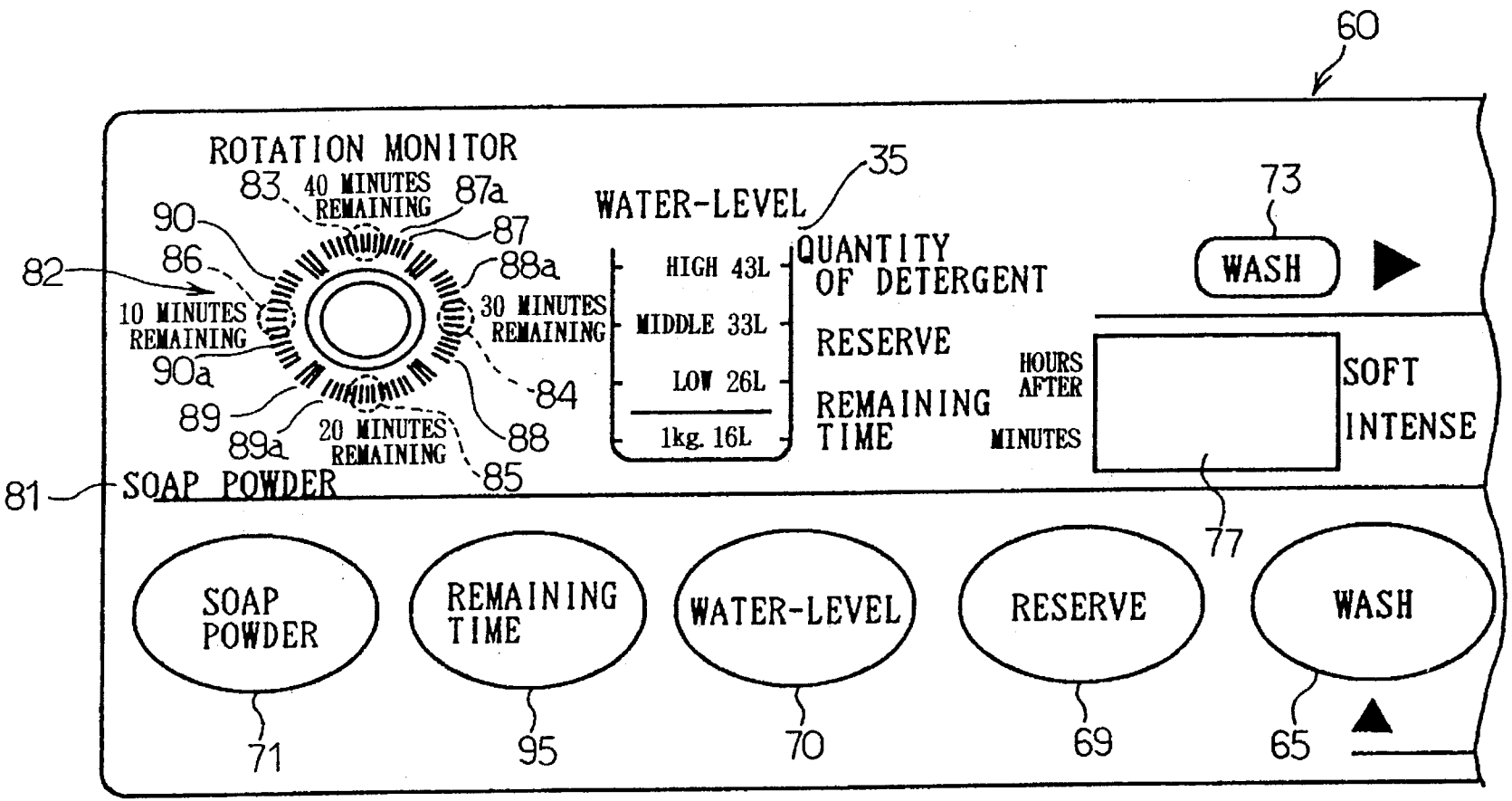
FIG. 18 is a partial flat view of an operation panel of a washing machine of a seventh embodiment according to the present invention.

FIG. 18 illustrates a seventh embodiment of the invention. The differences between the fourth and seventh embodiments will be described. The rotation monitor 82 further serves as a display section for displaying a remaining time of the wash step in the seventh embodiment. For this purpose, indications, "40 MINUTES REMAINING, MINUTES REMAINING," "20 MINUTES REMAINING," and "10 MINUTES REMAINING" are provided outside the line portions **87*a*–90*a* of the first to fourth light transmitting portions 87–90 so that the remaining time is displayed in the unit of 10 minutes. Furthermore, a REMAINING TIME display key switch 95 is provided on the operation panel 60. Upon operation of the REMAINING TIME display key switch 95, one of the first to fourth light-emitting diodes 83–86 corresponding to a remaining time is lighted. Upon subsequent operation of the key switch 95, the rotation monitor 82 displays the rotational state of the dehydrating tub 4 or the agitator 5**.

According to the seventh embodiment, the remaining time of the wash step can conveniently be understood in the analog manner because light emits through one of the oval light transmitting portions 87–90.

The present invention should not be limited to the foregoing embodiments and may be modified as follows. Although the line portions **87*a*–90*a* of the light transmitting portions 87–90 are arranged into the oval shape in the foregoing embodiments, they may be arranged into a completely round shape. Each of the light transmitting portions 87–90** may be formed into the shape of an arc-shaped band. Furthermore, each light transmitting portion may be square or may be triangular or polygonal depending upon the number of the light-emitting diodes. Thus, each light transmitting portion may be shaped so that the light emitting portion is shifted sequentially from one light transmitting portion to another in the form of a loop.

Although the light-emitting diodes are employed as the light emitting elements in the foregoing embodiments, they may be lamps instead. Furthermore, the combination of the control circuit 41 serving as the control means and the rotation sensor 93 serving as the rotation detecting means functions as the laundry quantity detecting means and as the washing time setting means for setting the washing period of time on the basis of the determined quantity of laundry in the foregoing embodiments. The laundry quantity detecting means may be arranged to detect a phase difference between the voltage and current of the motor 8 so that the magnitude of load applied to the motor 8 is determined and the quantity of laundry is determined on the basis of the determined magnitude of load, instead.

All the first to fourth light-emitting diodes 83–86 may be lighted or flashed during stop of the dehydrating tub 4 or the agitator 5. Furthermore, the elastic sheet 60*a* composing the surface of the operation panel 60 may be made from another material. The rotation monitor 82 may be for exclusive use either for the dehydrating tub 4 or the agitator 5. Alternatively, two rotation monitors 82 may be provided for exclusive use for the respective dehydrating tub and the agitator.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A washing machine comprising:

an electric motor;

a dehydrating tub provided to be rotated by the electric motor and centrifugally dehydrating laundry accommodated therein when rotated at high speeds;

water-supply means for supplying water to the dehydrating tub so that the water is poured onto the laundry;

speed selecting means selecting a rotational speed of the dehydrating tub between a low speed state establishing a water pouring stage and a high speed state establishing a centrifugal dehydration stage, thereby performing a rinse-with-dehydration operation in which the water is supplied to the dehydrating tub by the water-supply means in the water pouring stage so that the laundry is rendered hydrous and in which the water supply by the water-supply means is substantially stopped and the laundry is centrifugally dehydrated in the centrifugal dehydration stage subsequent to the water pouring stage;

means for detecting a rotation angle of the dehydrating tub in the water pouring stage;

area setting means for setting the interior of the dehydrating tub into a plurality of circumferential areas according to the detected rotation angle;

timer means for detecting a period of time required for each set area to pass a water pouring location of the water-supply means; and means for determining a hydrous state of the laundry on the basis of the result of detection by the timer means.

2. A washing machine according to claim 1, further comprising water-supply control means stopping the water supply when the time periods required for all the set areas to pass the water pouring location each become equal to or exceed a predetermined reference period of time, the time periods being detected by the timer means.

3. A washing machine according to claim 2, further comprising water-supply capacity determining means for determining the water-supply capacity of the water-supply means and reference time period changing means for changing the reference time period according to the result of detection by the water-supply capacity determining means.

4. A washing machine according to claim 1, further comprising control means for starting and stopping the water supply in the water pouring stage individually for each set area and water-supply control means for controlling the water-supply means so that the same sequentially stops the water supply to the set areas when the time periods required for the respective set areas to pass the water supply location sequentially become equal to or exceed a reference period of time, the time periods being detected by the timer means.

5. A washing machine according to claim 4, further comprising water-supply capacity determining means for determining the water-supply capacity of the water-supply means and reference time period changing means for changing the reference time period according to the result of detection by the water-supply capacity determining means.

6. A washing machine according to claim 1, further comprising a display having display sections displaying the respective set areas and display control means for activating the display sections corresponding to the set areas when the time periods required for the respective set areas to pass the water supply location each become equal to or exceed a reference period of time so that a display status is switched, the time periods being detected by the timer means.

7. A washing machine according to claim 6, further comprising:

an agitator provided in the dehydrating tub;

rotation detecting means for detecting rotation of the motor, thereby generating a detection signal;

monitor control means, responsive to the detection signal from the rotation detection means, for controlling the display so that the display sections sequentially emit light during rotation of either the agitator or the dehydrating tub; and wherein the display sections of the display are arranged into the form of a loop.

8. A washing machine according to claim 7, wherein the display sections of the display comprise respective light-emitting elements and respective light transmitting portions through which light emitted by the respective light-emitting elements is transmitted, whereby each light transmitting portion serves as a light emitting portion, and the light transmitting portions are arranged into a circular or an oval shape.

9. A washing machine according to claim 8, wherein the light-emitting elements are capable of emitting a plurality of different colors of light and the color of light emitted by the light-emitting elements is differentiated one step of the washing operation from another.

10. A washing machine according to claim 9, wherein all the light-emitting elements are turned on, turned off, or flashed during stop of the dehydrating tub or the agitator.

11. A washing machine according to claim 8, wherein all the light-emitting elements are turned on, turned off, or flashed during stop of the dehydrating tub or the agitator.

12. A washing machine according to claim 8, wherein the display also serves to display a selected water-level and light is emitted from one of the display sections corresponding to the selected water-level when the water level is displayed.

13. A washing machine according to claim 8, wherein the display also serves to display a remaining period of time of a wash step and light is emitted from one of the display sections corresponding to a remaining time period of the wash step under a given operation mode.

14. A washing machine according to claim 7, wherein the light emitting portion emitting the light on the display is shifted sequentially from one light transmitting portion to another at a speed according to a rotational speed of the dehydrating tub or the agitator.

15. A washing machine according to claim 14, wherein all the light-emitting elements are turned on, turned off, or flashed during stop of the dehydrating tub or the agitator.

16. A washing machine according to claim 7, wherein the light emitting portion emitting the light on the display is shifted sequentially from one light transmitting portion to another in a direction same as a direction of rotation of the dehydrating tub or the agitator.

17. A washing machine according to claim 16, wherein all the light-emitting elements are turned on, turned off, or flashed during stop of the dehydrating tub or the agitator.

* * * * *